United States Patent [19]

Sizer et al.

[11] 4,251,176

[45] Feb. 17, 1981

[54] WELL TUBING HANDLING APPARATUS

[75] Inventors: Phillip S. Sizer, Dallas; Malcolm N. Council, Richardson, both of Tex.

[73] Assignee: Otis Engineering Corporation, Dallas, Tex.

[21] Appl. No.: 938,518

[22] Filed: Aug. 31, 1978

[51] Int. Cl.[3] ..... E21B 19/00

[52] U.S. Cl. ..... 414/22; 166/77; 175/5; 175/85; 254/336; 414/745

[58] Field of Search ..... 414/22, 745; 175/52, 175/85, 51, 5; 166/77; 187/9 E; 254/187, 188, 168, 139

[56] References Cited

U.S. PATENT DOCUMENTS

| | | | |
|---|---|---|---|
| 2,324,096 | 7/1943 | Lilly | 414/22 X |
| 2,681,623 | 6/1954 | Kane | 254/188 X |
| 3,266,582 | 8/1966 | Homanick | 414/22 X |
| 3,280,920 | 10/1966 | Scott | 414/22 X |
| 3,835,940 | 9/1974 | Winter, Jr. | 175/85 |
| 3,949,883 | 4/1976 | Crooke | 414/22 X |
| 3,998,432 | 12/1976 | Uldricks | 254/168 |
| 4,024,925 | 5/1977 | Brown | 175/85 |

FOREIGN PATENT DOCUMENTS

| | | | |
|---|---|---|---|
| 975679 | 10/1975 | Canada | 166/77 |

*Primary Examiner*—Stephen G. Kunin
*Assistant Examiner*—Terrance L. Siemens
*Attorney, Agent, or Firm*—H. Mathews Garland

[57] ABSTRACT

Well tubing handling apparatus useful for running and pulling tubing in a well bore and drilling a well bore including a main frame assembly, a pulling and snubbing assembly, a ladder assembly, and a work platform assembly. The apparatus is quickly assembled and torn down. The main frame assembly includes a base, telescoping non-load bearing guide tubes, a load-bearing mast, fixed slips, and winches and sheave and cable assemblies for manipulating pipe joints between handling positions in the apparatus and a pipe rack. The pulling and snubbing assembly includes a hydraulic cylinder connectible at the free end of the piston on the frame base, sheave mounted drive cables secured on the cylinder, traveling slips mounted on the drive cables, and an anchor between the drive cables and the main frame so that as the cylinder is raised and lowered the cables are driven around pulleys raising and lowering the traveling slips. A valve block is mounted on the base end of the cylinder for connection with a source of hydraulic power. The frame and pulling and snubbing assemblies include guide structure for quick coupling of the assemblies together. The apparatus may be fully supported on a wellhead.

37 Claims, 57 Drawing Figures

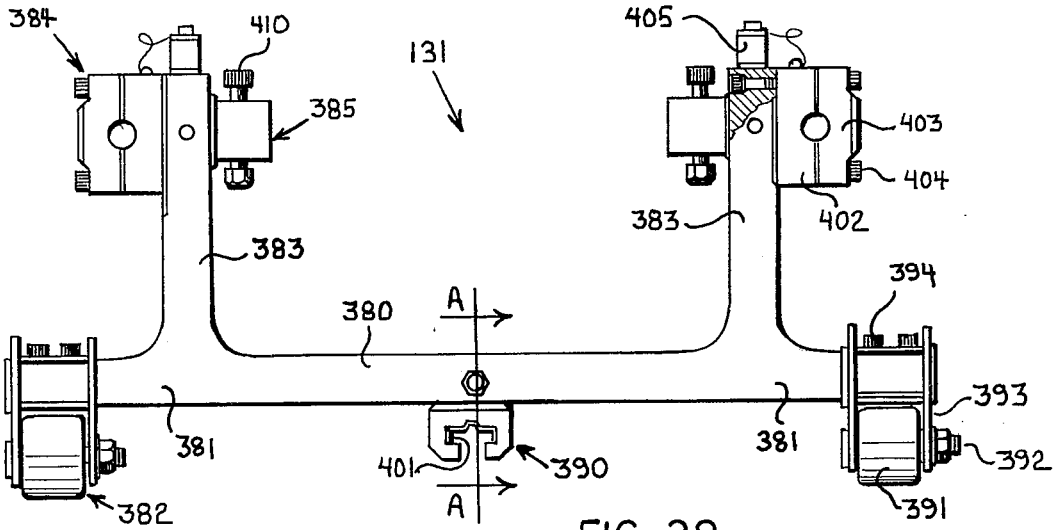
FIG.-28
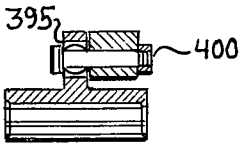
FIG.-30
FIG.-29A
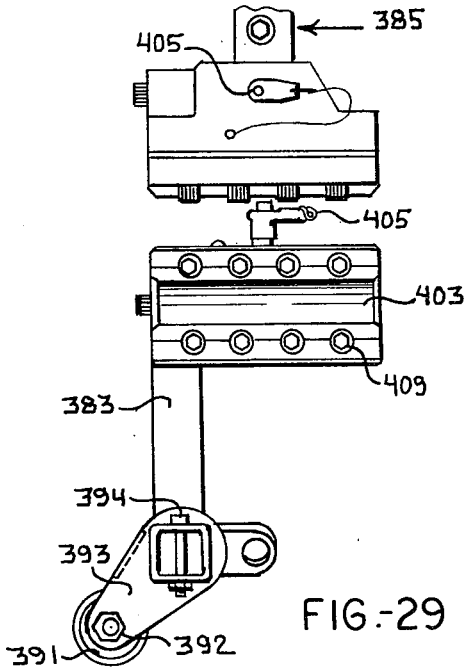
FIG.-29
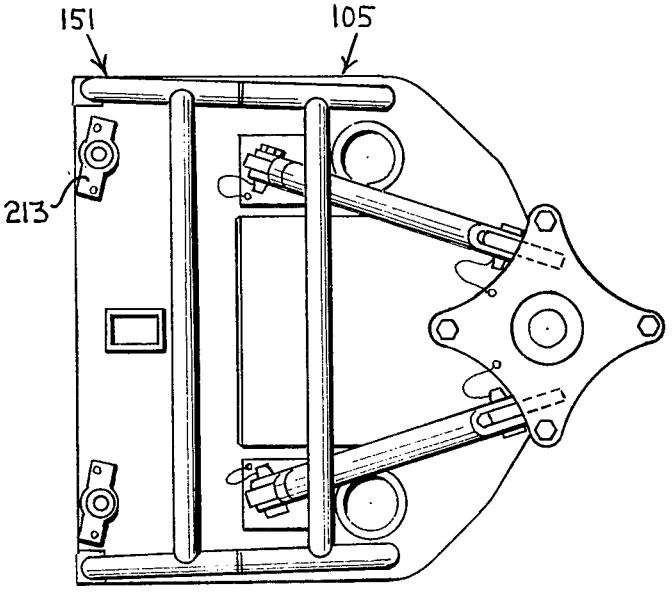
FIG.-19

WELL TUBING HANDLING APPARATUS

SUMMARY OF THE INVENTION

This invention relates to apparatus for handling tubing strings in well bores and more particularly relates to a system for running and pulling tubing in a well bore and drilling a well bore including snubbing tubing into a well bore through a wellhead under pressure.

It is well known to service wells, particularly oil and gas wells, using portable rigs. Such well servicing includes the repair of production tubing strings requiring pulling the tubing string from the well bore and thereafter running the tubing string back into the well bore. Such well tubing handling may be done with or without fluid pressure in the well bore. With the development of offshore wells it is often necessary that such work be carried on in remote locations on platforms above the surface of the water. Thus there is a particular need for portable drilling rigs which can be carried to such offshore locations by helicopter.

While there are a number of portable well tubing handling rigs available, they are generally constructed in such a manner that the total weight of the rig exceeds helicopter handling capacities. Some of the available rigs are mounted on wellheads in such a manner that the height of the wellhead is a factor in the operating stroke of the rig. Some such rigs cannot be readily removed from a wellhead in the event of malfunction of the rig at an interim stage in the workover of a well. Some such rigs require complete draining of the hydraulic fluid from the power components of such rigs. In many available portable rigs the mast employed includes load bearing members resulting in a bulkier structure than desired. Some such rigs require auxiliary erecting equipment to properly position the rig on a well at operating height. Some available rigs require the use of external guy wires extending to the upper end of the mast. Some such rigs cannot be directly mounted on a wellhead but rather require some form of auxiliary support at the base of the rig.

It is, therefore, a principal object of the invention to provide a new and improved apparatus for running and pulling well tubing in a well bore.

It is another object of the invention to provide well tubing handling apparatus which is capable of running tubing into a well bore under pressure.

It is another object of the invention to provide well tubing handling apparatus which is capapable of rotating the tubing during running and pulling.

It is another object of the invention to provide a well tubing handling apparatus which comprises several subassemblies which are sufficiently lightweight for helicopter handling and are quickly and easily erected and torn down.

It is another object of the invention to provide a well tubing handling apparatus wherein the well tubing being manipulated by the apparatus may be suspended in a well bore and the apparatus removed and replaced in the event of a malfunction.

It is another object of the invention to provide well tubing handling apparatus including extensible guide tubes which are elevated to operating height by the power system of the apparatus.

It is another object of the invention to provide well tubing handling apparatus which does not require guy wires from the top of the mast of the apparatus.

It is another object of the invention to provide well tubing handling apparatus which is mounted directly on a wellhead.

It is another object of the invention to provide well tubing handling apparatus wherein the hydraulic fluid used to power the apparatus may be left in the power system when the apparatus is dismantled.

It is another object of the invention to provide well tubing handling apparatus including pipe handling winches as a part of the main frame of the apparatus.

It is another object of the invention to provide well tubing handling apparatus which is operable at full stroke regardless of the height of the wellhead.

It is another object of the invention to provide well tubing handling apparatus which employs guide tubes which are not load bearing members.

It is another object of the invention to provide a well tubing handling apparatus which includes a power subassembly having wrap around type bearings for coupling the power cable system of the apparatus with the guide tubes of the main frame.

It is another object of the invention to provide well tubing handling apparatus including remotely controlled latches for locking and releasing the extensible telescoping guide tubes of the main frame.

It is another object of the invention to provide well tubing handling apparatus including structure for raising the extensible guide tubes of the main frame to an elevation above the end of the full stroke of the hydraulic cylinder of the power assembly of the apparatus.

It is another object of the invention to provide well tubing handling apparatus which includes structure for counteracting the torque effect of the tubing rotating system of the apparatus.

In accordance with the invention there is provided well tubing handling apparatus including a main frame assembly and a tubing running and pulling power assembly releasably connectible with the main frame assembly. A work basket and a ladder are connectible with the main frame assembly. In a more specific form of the invention the main frame assembly includes telescoping extensible guide tubes which are non-load bearing, a loadbearing mast member, a base, fixed slips on the base, and tubing handling winches, cables, and sheaves for moving tubing between the pipe rack and the apparatus. The power assembly includes a hydraulic cylinder assembly having a piston rod connected with the base and an extensible cylinder supporting end sheaves around which are reaved power cables connected at ends between the sheaves with the main frame assembly mast member, and traveling slips secured on the power cables between the sheaves and coupled with a guide an anti-torque device including guide rollers engageable with the guide tubes and a slidable bracket engageable with the hydraulic cylinder.

The foregoing objects and advantages of the invention will be better understood from the following detailed description of a preferred embodiment thereof taken in conjunction with the accompanying drawings wherein:

FIG. 19 is a bottom view of the structure shown in FIG. 18;

FIG. 28 is a top view of the traveling slip assembly yoke;

FIG. 29 is a right end view of the yoke shown in FIG. 28;

FIG. 29A is a fragmentary front view in elevation of the right end of the yoke as shown in FIG. 28;

FIG. 30 is a view in section along the line 30—30 of FIG. 28;

Figure 31A:
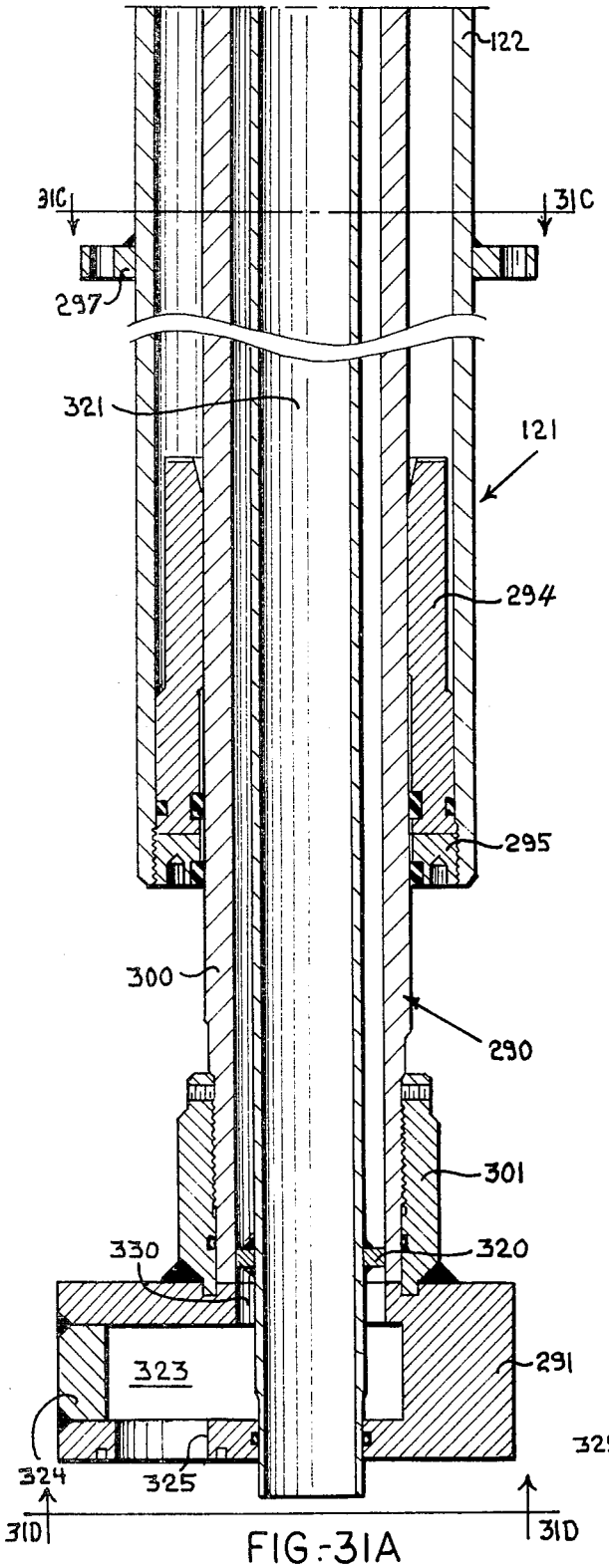
Figure 31B:
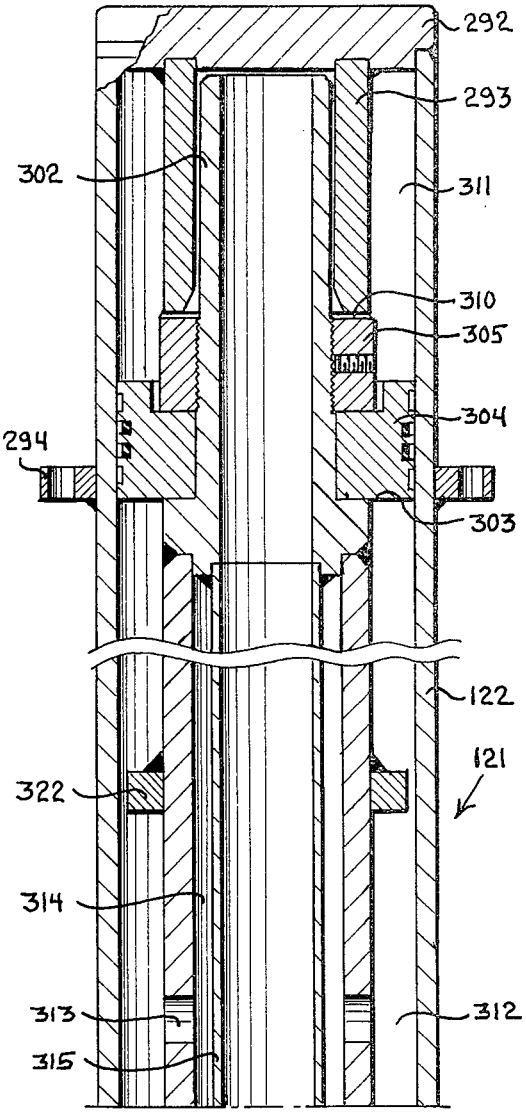
Figure 31D:
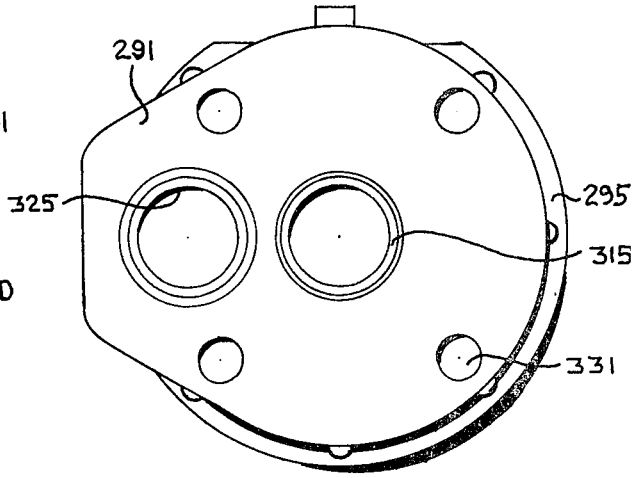
Figure 31C:
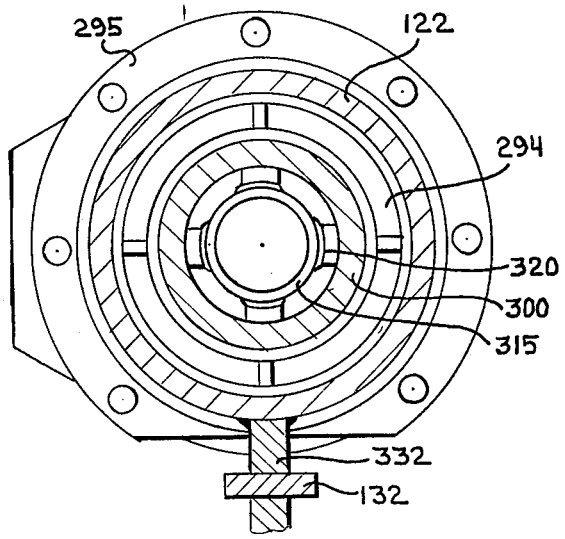

FIGS. 31A and 31B taken together comprise a broken longitudinal view in section of the hydraulic cylinder of the power assembly of the apparatus on which the power cable and sheave assembly is mounted;

FIG. 31C is a sectional view along the line 31C—31C of FIG. 31A.

FIG. 31D is a bottom view along line 31D—31D of FIG. 31A.

Figure 36:
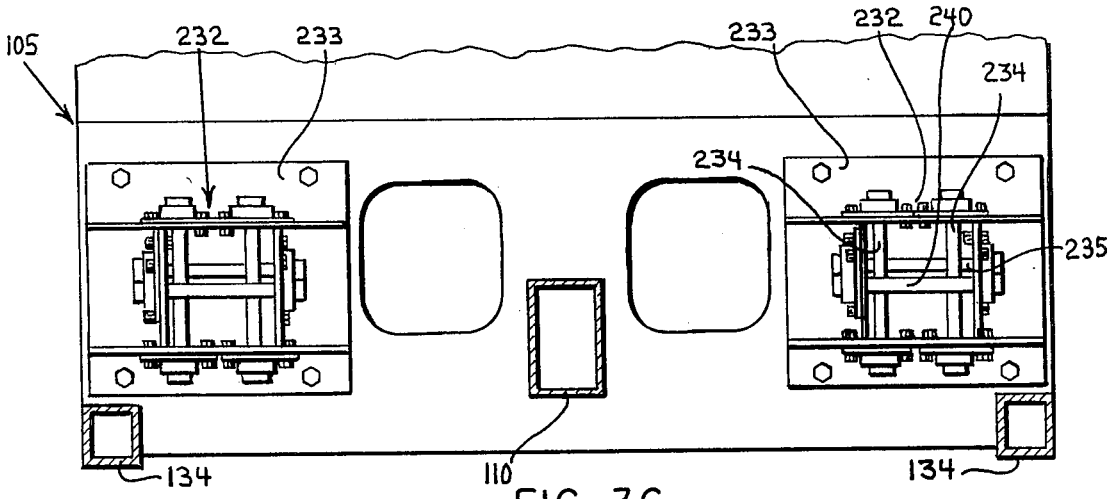
Figure 40:
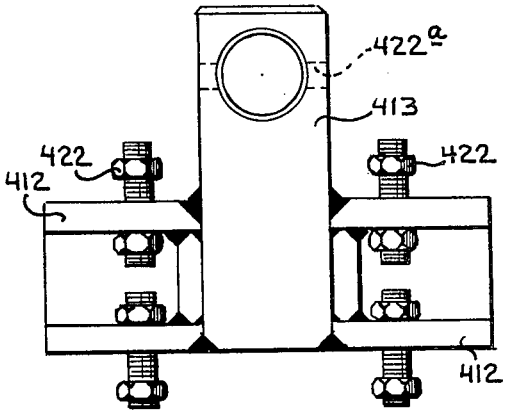
Figure 32:
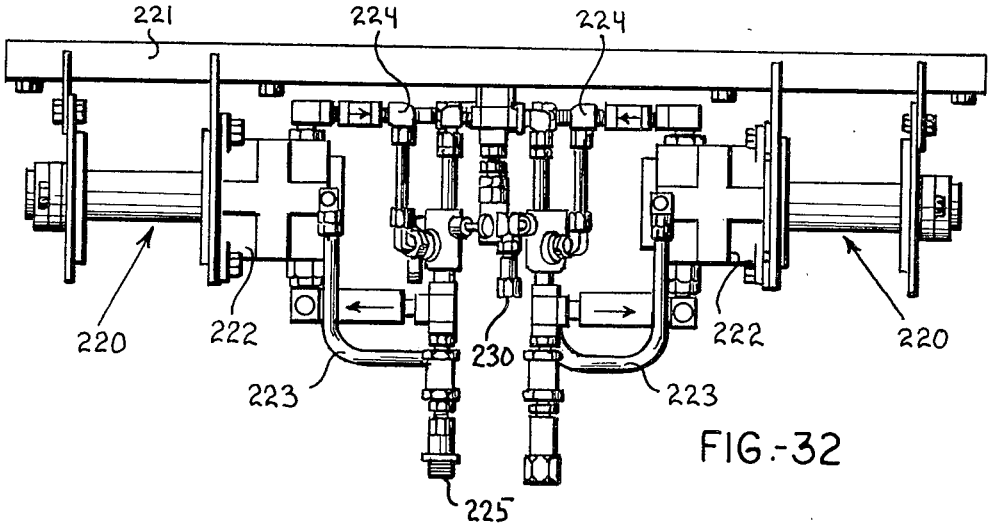
Figure 34:
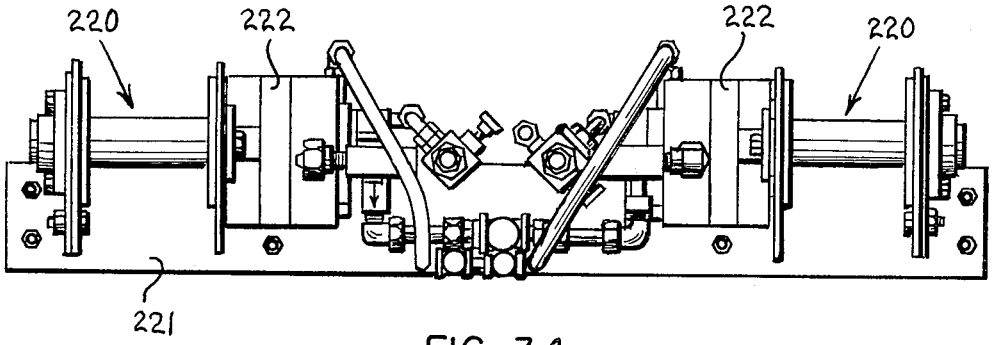
Figure 33:
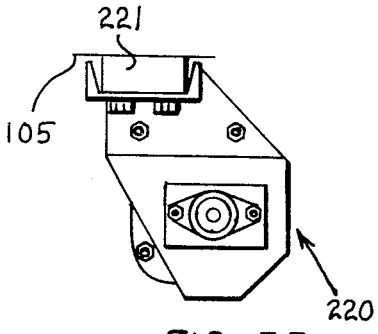
Figure 35:
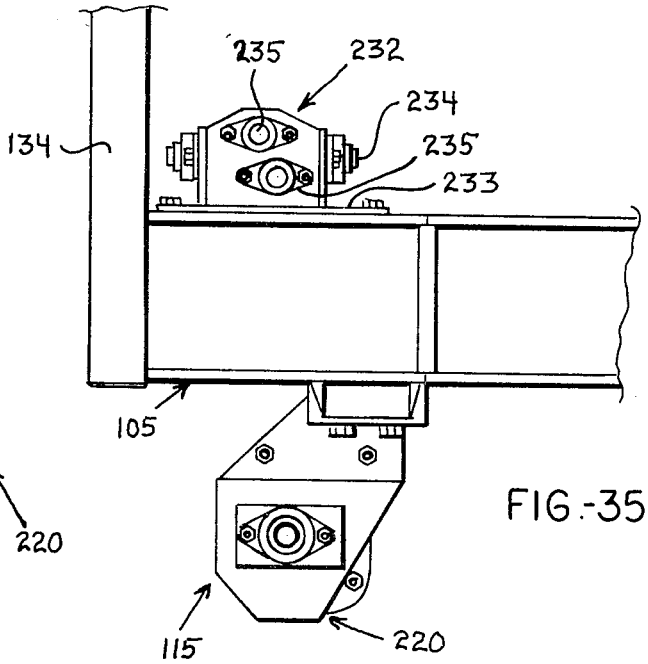
Figure 39:
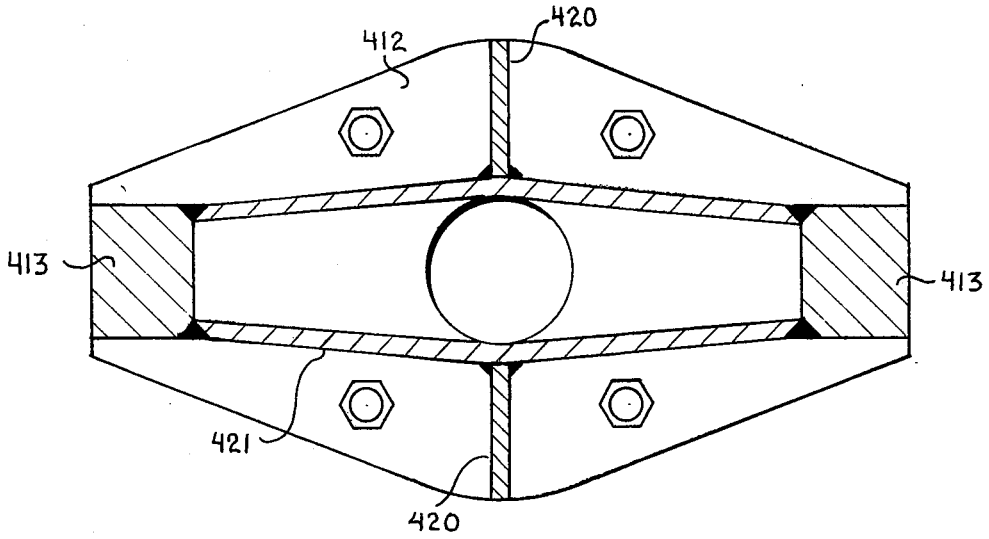
Figure 38:
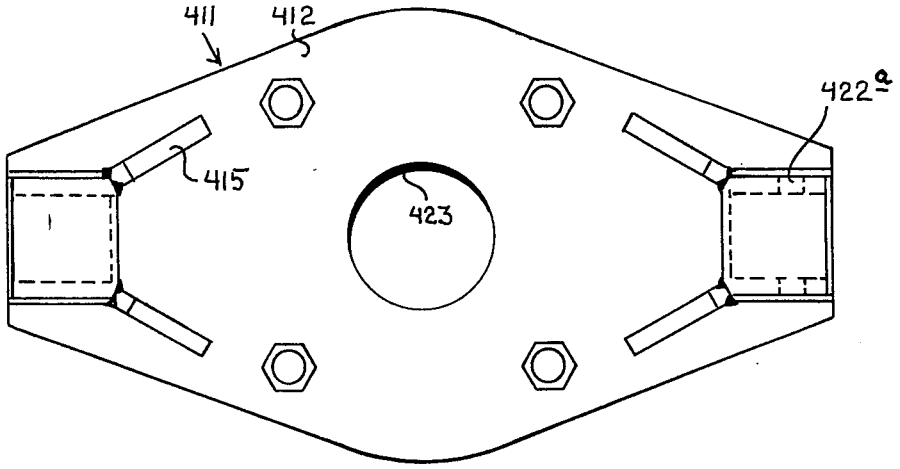
Figure 37:
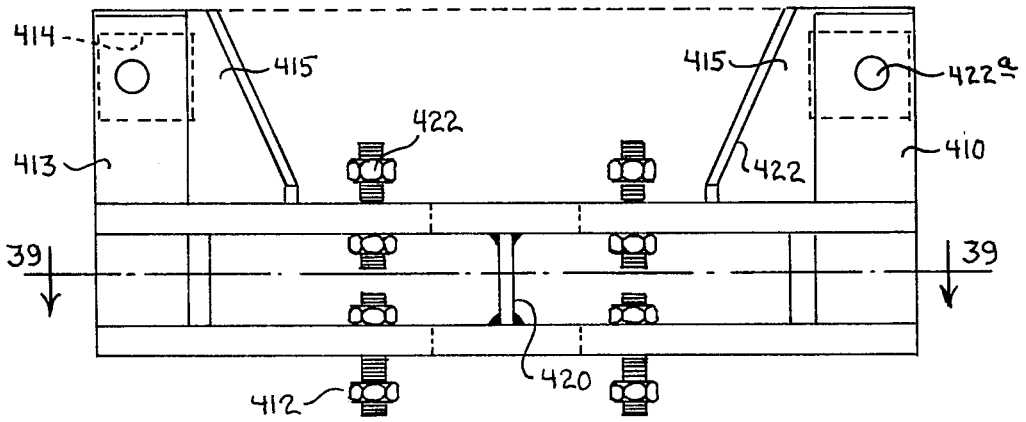
Figure 41:
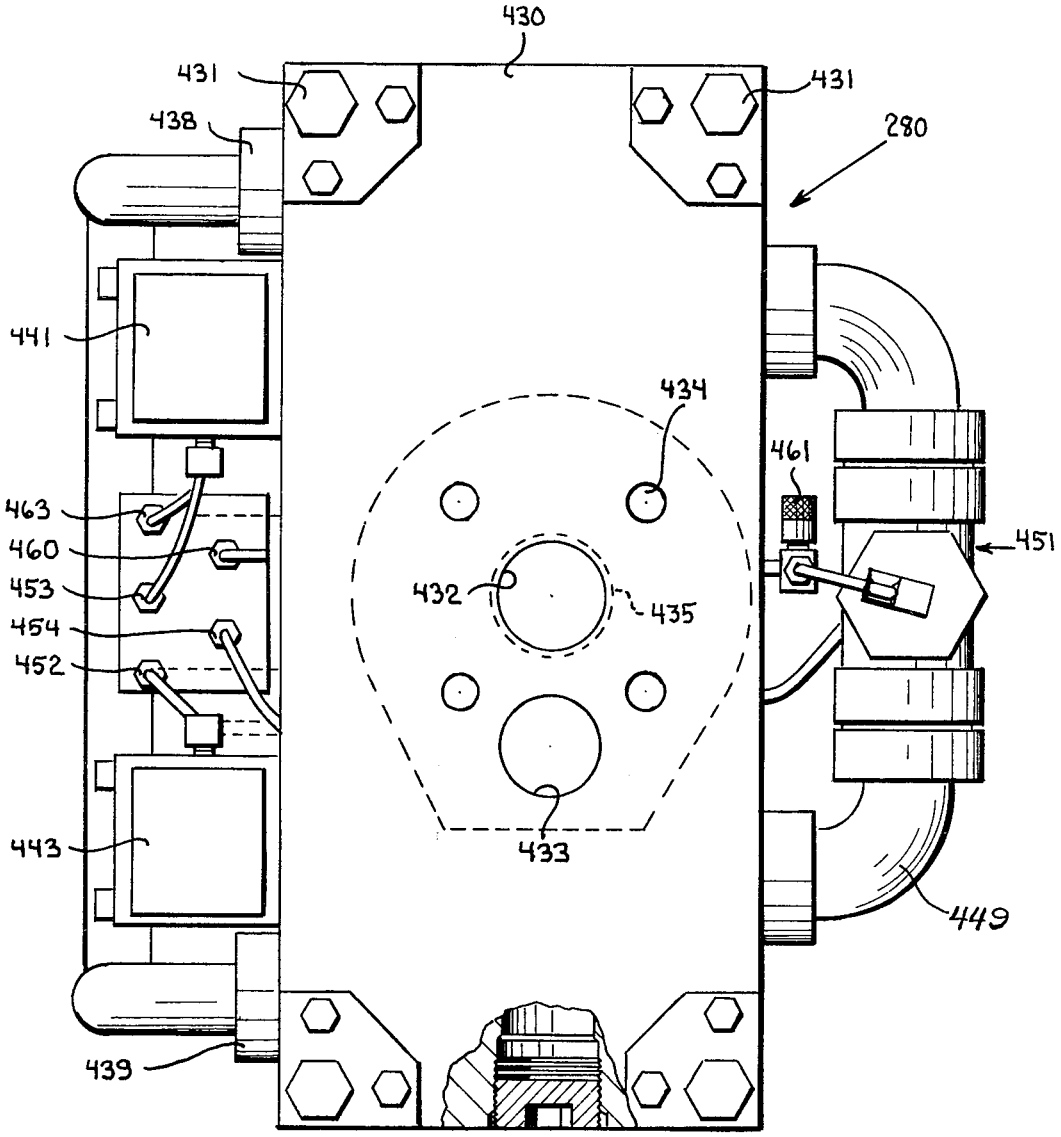
Figure 42:
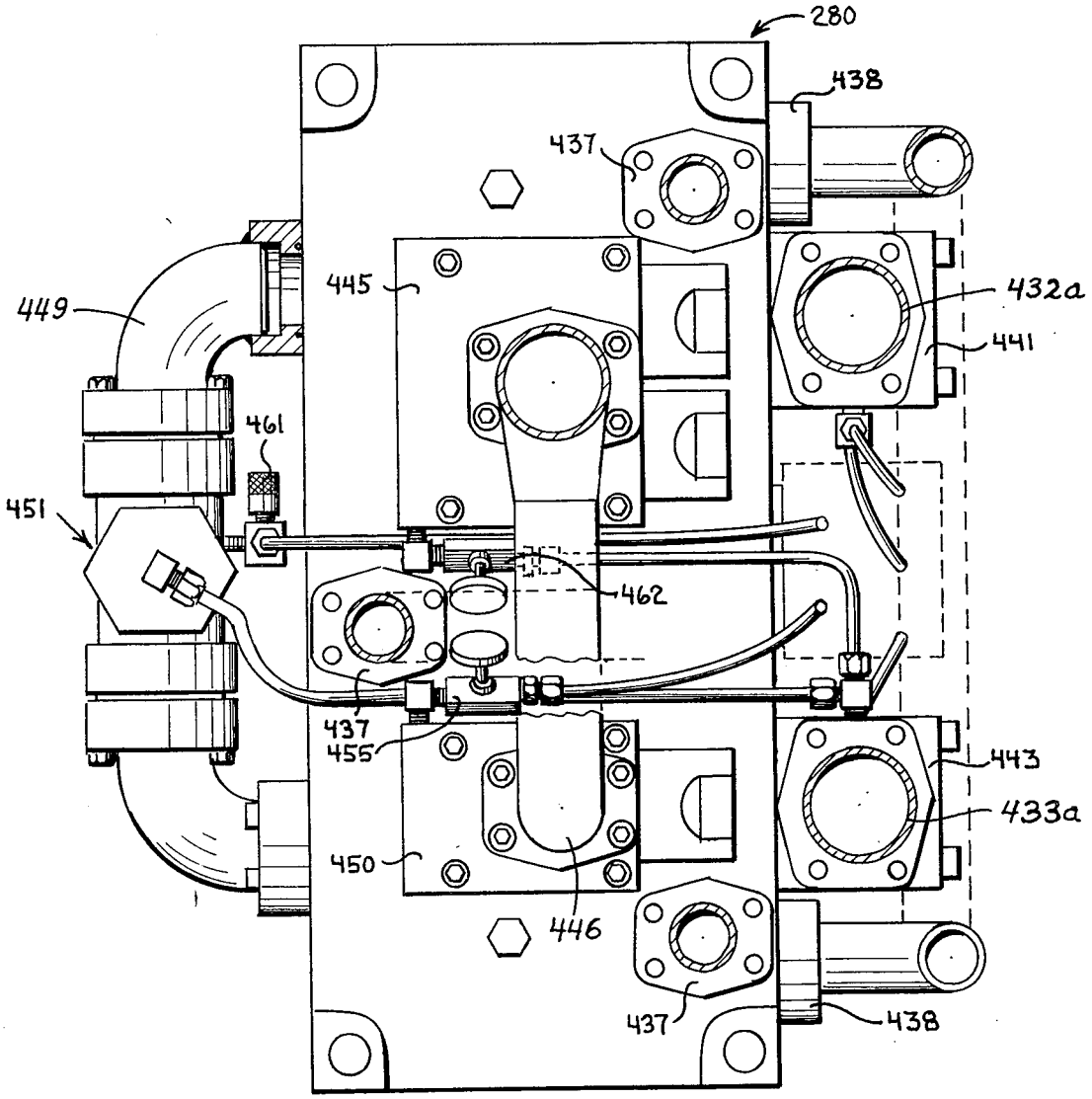
Figure 43A:
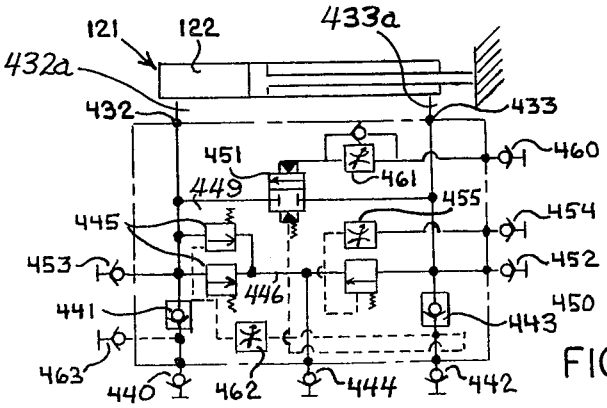
Figure 43:
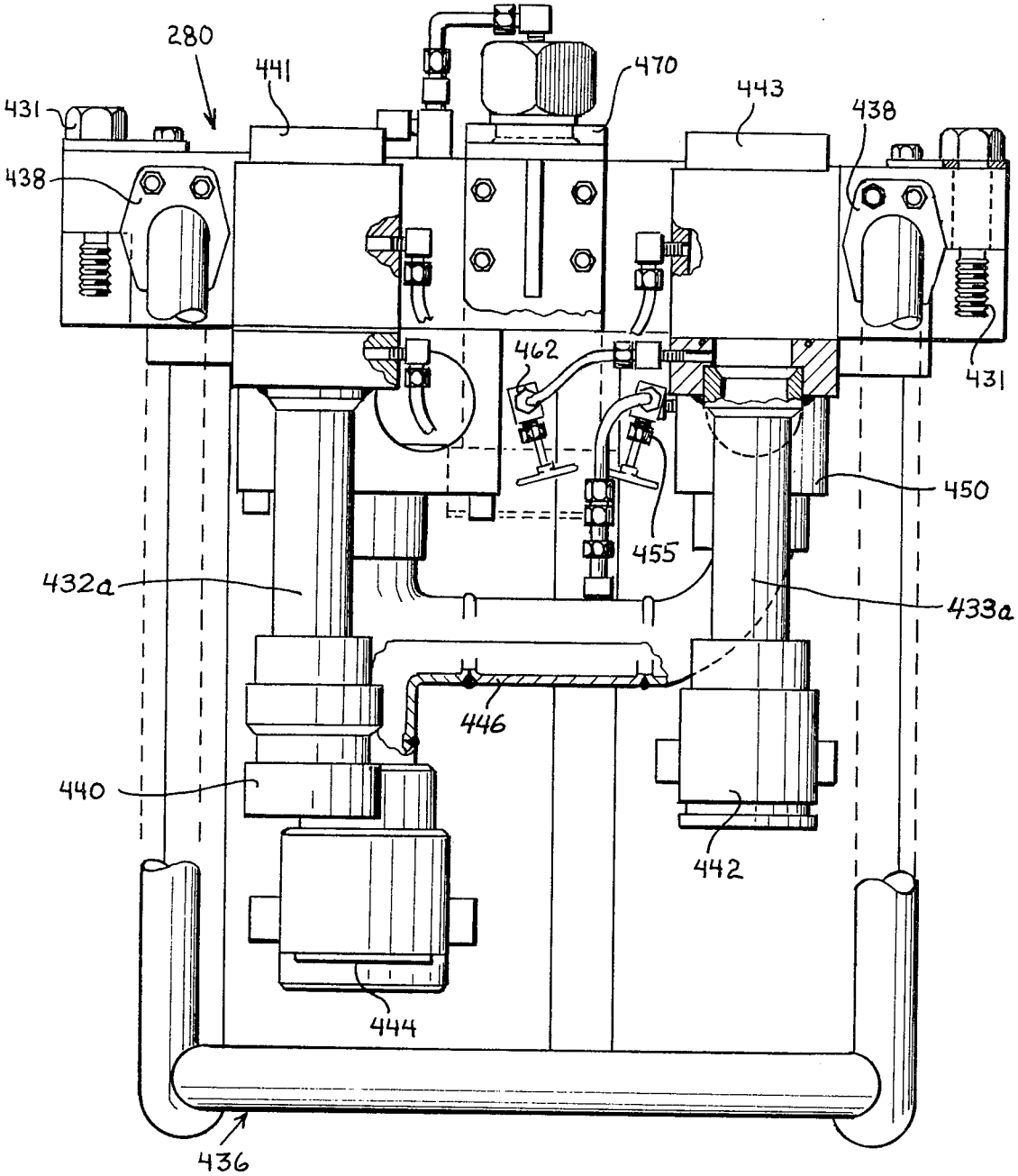
Figures 44, 45, 46, 47:
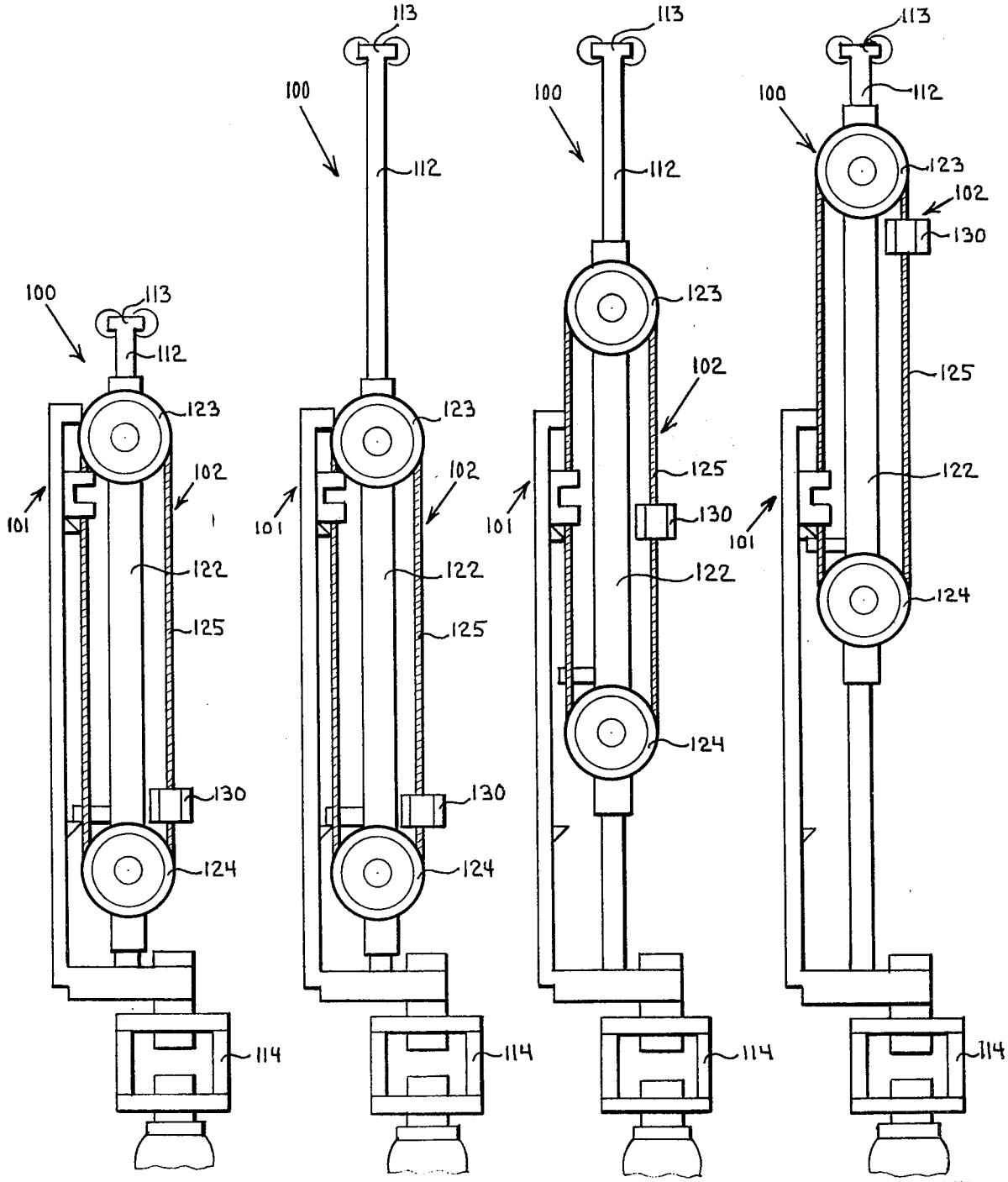
Figure 48:
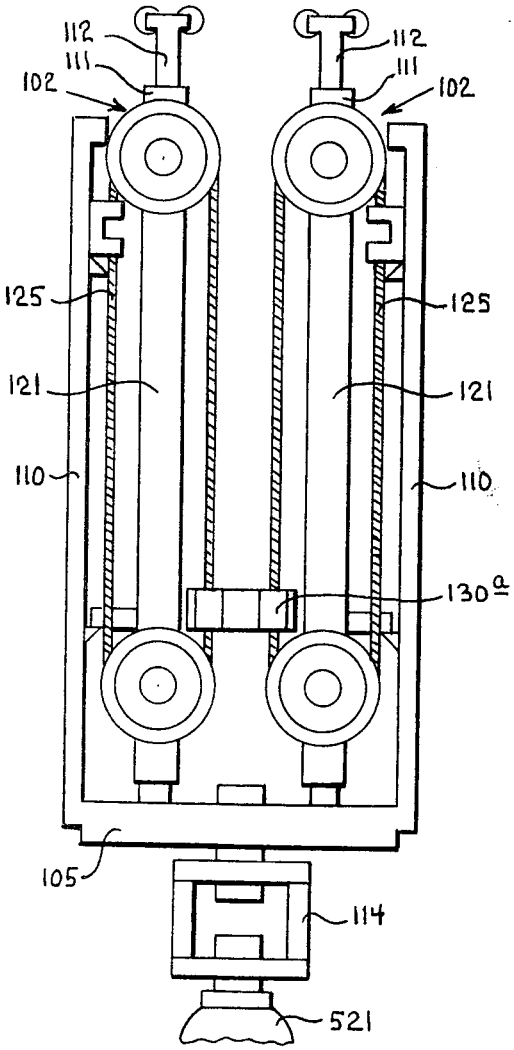

FIG. 32 is a front view in elevation of the pipe handling winch assemblies mounted on the bottom of the main frame base;

FIG. 33 is a left end view of the winch assembly shown in FIG. 32;

FIG. 34 is a bottom view of the winch assembly of FIG. 32;

FIG. 35 is a fragmentary left end view of the winch assembly on the bottom of the main frame base and the pipe handling cable guide assembly on the top of the main frame base;

FIG. 36 is a fragmentary top view of the main frame base showing the pipe handling cable guide assemblies associated with the winch assemblies;

FIG. 37 is a front view of the traveling slip mounting assembly;

FIG. 38 is a top view of the assembly of FIG. 37;

FIG. 39 is a view in section of the slip support assembly shown along the line 39—39 of FIG. 37;

FIG. 40 is a right end view of the assembly of FIG. 37;

FIG. 41 is a top view of the valve block assembly of the power assembly of the apparatus;

FIG. 42 is a bottom view of the valve block assembly shown in FIG. 41;

FIG. 43 is a front view of the valve block assembly of FIGS. 41 and 42;

FIG. 43A is a flow diagram of the valve block hydraulic fluid system;

FIG. 44 is a schematic side view of the apparatus illustrating only the main frame assembly and the power assembly with the extensible guide tubes fully retracted;

FIG. 45 is a schematic side view similar to FIG. 44 showing the guide tubes of the main frame assembly fully extended;

FIG. 46 is a schematic side view of the apparatus as seen in FIGS. 44 and 45 illustrating the power assembly raised approximately a half stroke as during the pulling of tubing from a well bore;

FIG. 47 is a schematic side view of the apparatus illustrating the power assembly raised to the upper end of the full stroke; and FIG. 48 is a schematic side view in elevation of a modified form of the apparatus of the invention utilizing a dual arrangement of main frame assemblies and power assemblies for increased capacity operation.

Figure 1A:
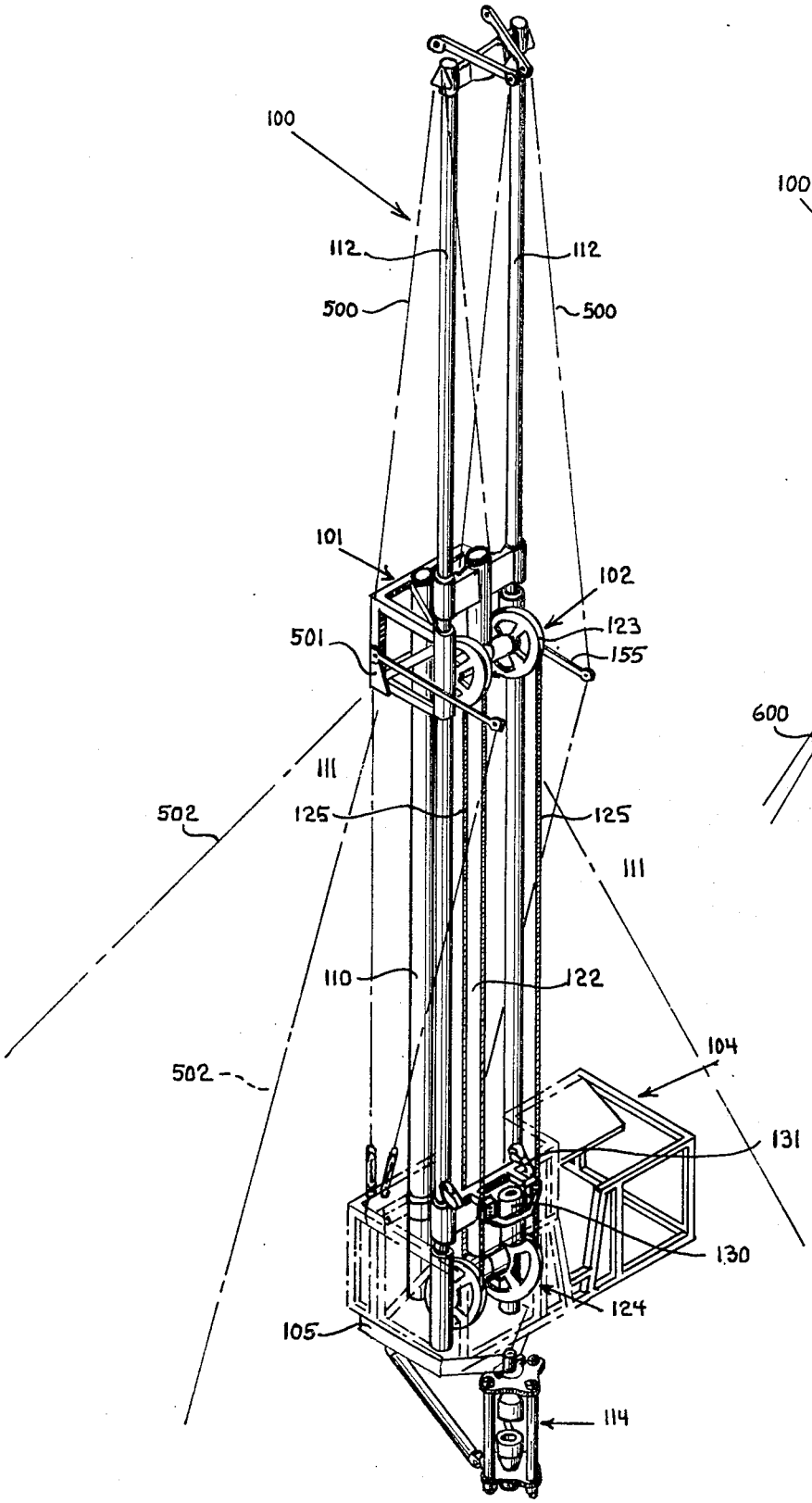
FIG. 1A is a schematic perspective view of a well tubing handling apparatus in accordance with the invention showing the extensible guide tubes elevated to operating height and the guy wires employed connected with the mast.
Figure 1B:
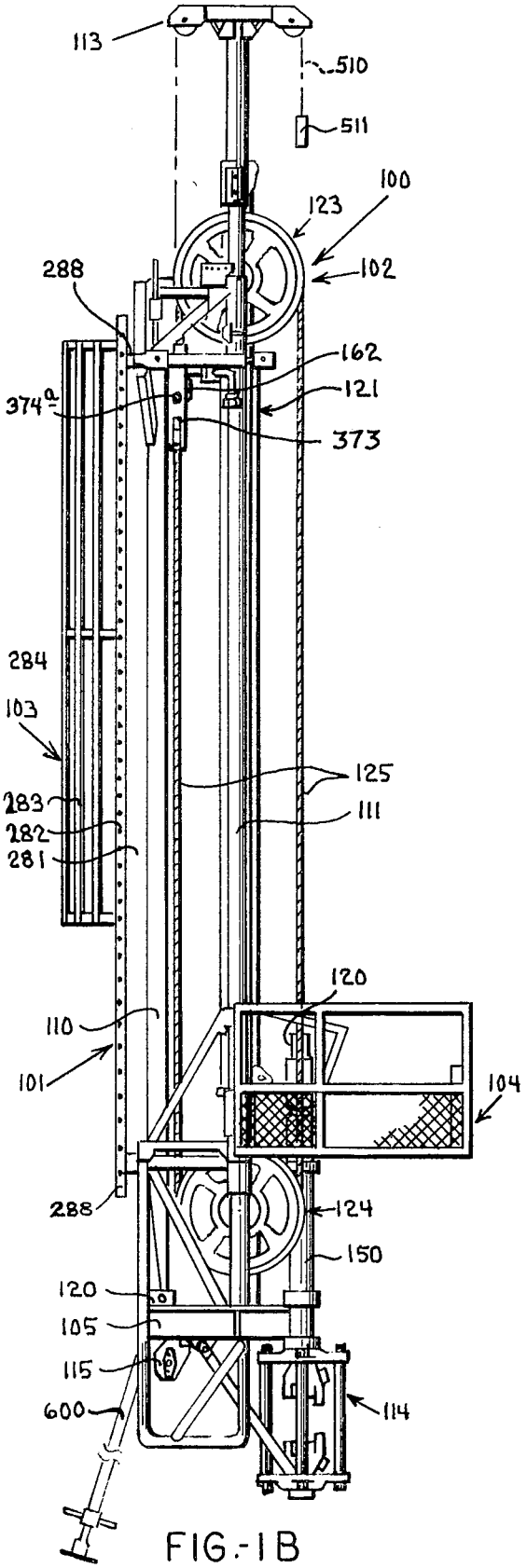
FIG. 1B is a side view in elevation showing the details of the apparatus of the invention with the guide tubes only partially extended.
Figure 1C:
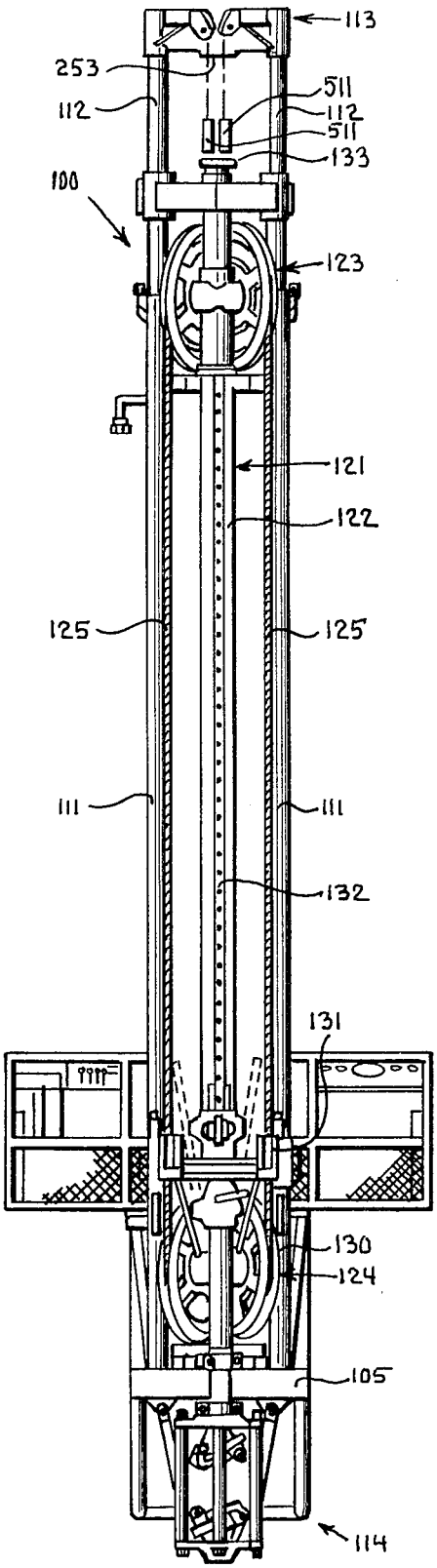
FIG. 1C is a front view in elevation of the apparatus as shown in FIG. 1B.

Referring to FIGS. 1A-1C, a well tubing handling apparatus 100 embodying the features of the invention includes a main frame assembly 101, a power assembly 102, a ladder assembly 103, and a work platform 104. The assemblies 101–104 inclusive is each sufficiently light and compact to be helicopter handled and may be quickly connected and disconnected when erecting and dismantling the apparatus on a wellhead. The details of construction of the main frame assembly 101 are illustrated in FIGS. 3–13, 16–19, and 32–36. The details of the power assembly 102 are shown in FIGS. 20–31B.

The main frame assembly 101 includes a base 105, a vertical mast member 110, laterally spaced parallel vertical side lower guide tubes 111, upper telescoping inner guide tubes 112 each of which slides in one of the lower outer tubes 111, and a crown assembly 113 mounted on the upper guide tubes 112. A fixed slip assembly 114 is secured below the frame base 105. A pipe handling winch assembly 115 is mounted on the bottom of the frame base 105 operating in conjunction with pipe handling cable guide assemblies 120 mounted on the top of the frame base 105.

The power assembly 102 includes a hydraulic cylinder assembly 121 having an upwardly extendible cylinder housing 122. Upper and lower sheave assemblies 123 and 124, respectively, are mounted in longitudinal spaced relation along the upper and lower end portions of the cylinder housing for vertical movement with the housing. Two power cables 125 are reeved around the sheaves on the assemblies 123 and 124. Each of the cables 125 passes around the sheaves on the corresponding side of the sheave assemblies with the free ends of each cable being anchored at fixed locations at the back side of the power assembly along the front of the upper portion of the frame mast 110. A traveling slip assembly 130 is supported on a guide yoke 131 clamped to the front side of the drive cables 125 between the upper and lower sheave assemblies. The guide yoke is slidably coupled with a guide rail 132 along the front side of the cylinder housing 122. An inflatable longitudinally extendible sleeve 133 is mounted on the upper end of the cylinder housing 122. The upper sheave assembly 123 includes guide bearings which slide along the upper guide tubes 112. Similarly the lower sheave assembly 124 includes guide bearings which slide along the lower guide tubes 111.

As will be described in greater detail hereinafter, delivery of hydraulic fluid to the cylinder assembly 121 raises the cylinder housing 122 lifting the sheave assemblies 123 and 124 with the housing. Since the power cables 125 are anchored along the back sides of the cables to the fixed main mast member 110, the cables must travel counterclockwise around the sheaves as viewed in FIG. 1B lifting the traveling slip assembly 130 at a rate twice the rate of upward movement of the cylinder housing. When the inner guide tubes 112 are fully extended a full stroke of the power assembly raises the traveling slips substantially the full height of the power assembly while the power assembly is moving substantially from a lower end position as shown in FIG. 44 to an upper end position as shown in FIG. 49 so that the traveling slips traverse a stroke extending from a lower end position near the lower ends of the lower guide tubes 111 to an upper end position near the upper ends of the upper guide tubes 112. Release of the hydraulic fluid from the cylinder assembly lowers the power assembly to the lower end of the stroke returning the traveling slips downwardly at a rate twice the rate of the cylinder housing to the lower end position. The fixed slip assembly 114 is employed to hold the tubing string while the power assembly is cycling between opposite ends of the stroke. By cycling the traveling slips tubing strings may be raised or lowered in a well bore. Directing hydraulic fluid into the cylinder assembly 21 to force the cylinder housing downwardly as described in detail hereinafter applies a downward force to the traveling slips for snubbing or forcing a tubing string into a well bore against well pressure.

Figure 3:
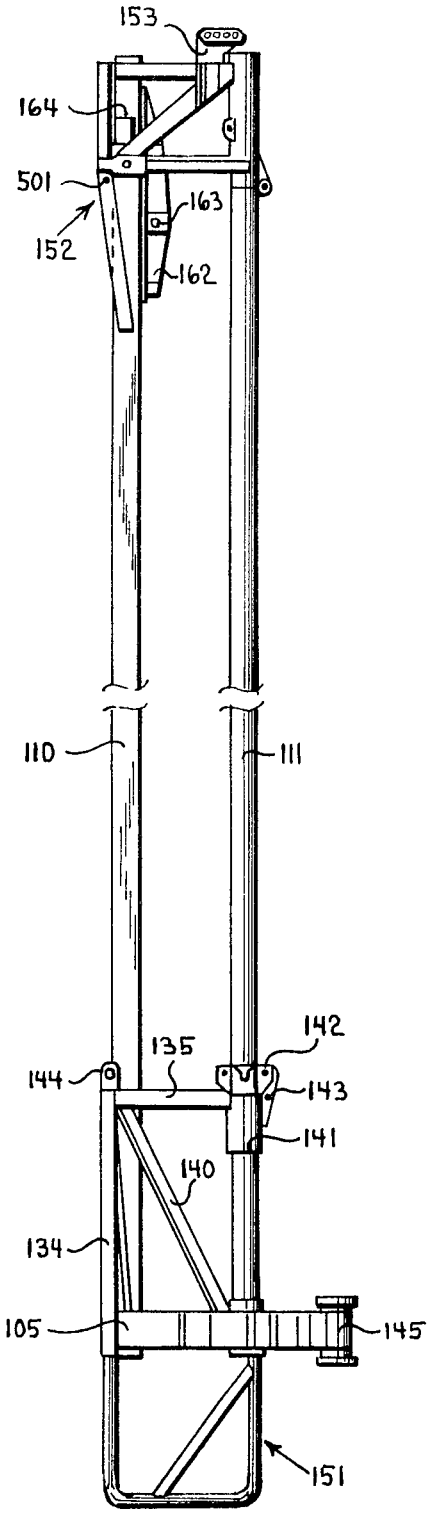
FIG. 3 is a broken side view in elevation of the lower subassembly of the main frame assembly.
Figure 4:
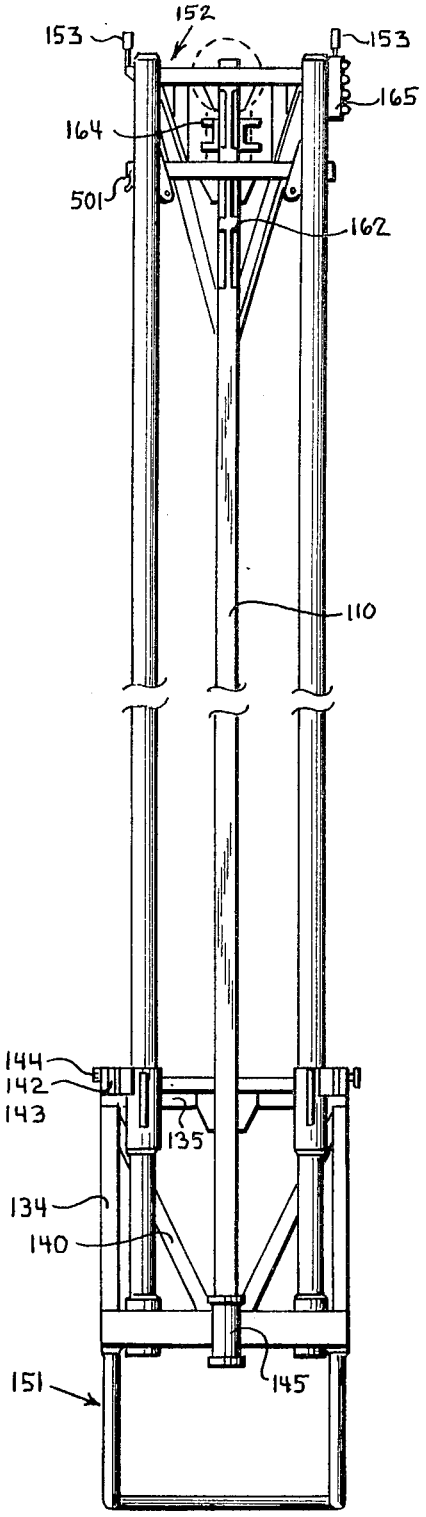
FIG. 4 is a broken front view in elevation of the lower main frame subassembly as seen in FIG. 3.
Figure 5:
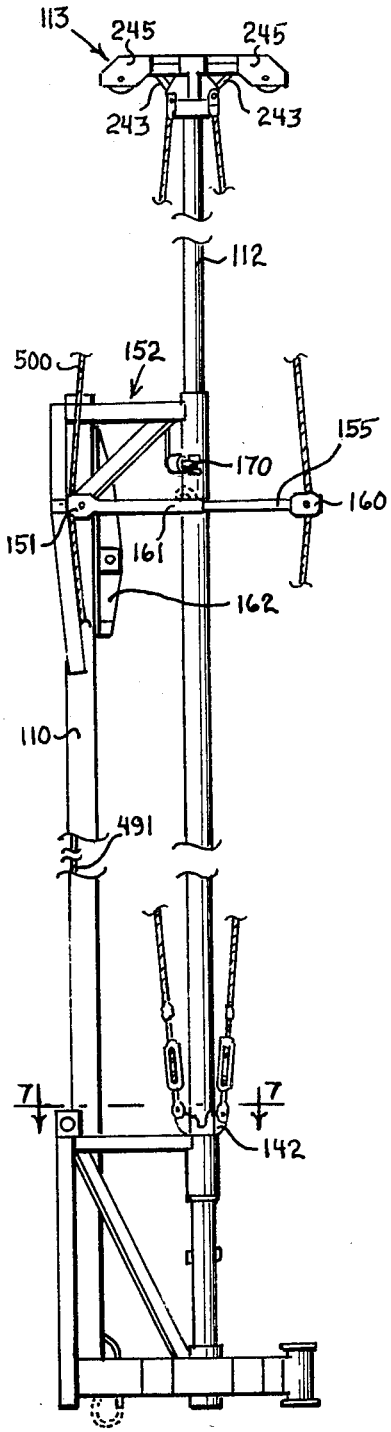
FIG. 5 is a broken side view in elevation of the main frame assembly including the extensible upper guide tubes, portions of the guy wire rigging, and the crown assembly.
Figure 8:
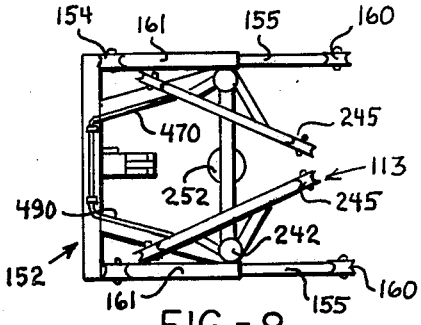
FIG. 8 is a top view of the main frame assembly as seen in FIG. 5.
Figure 15:
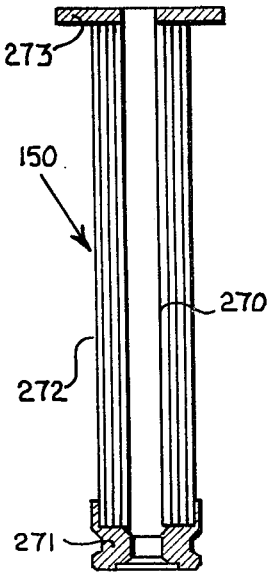
FIG. 15 is a longitudinal side view in section of the telescoping extensible pipe guide used when forcing pipe into a well bore under pressure with the apparatus.

The main frame assembly 101 is handled as a unit during erection and dismantling of the apparatus of the invention. The structural details of the main frame assembly are illustrated in FIGS. 3–13, 16–19, and 32–36. Referring to such drawings, the main frame assembly has a subassembly illustrated in part in FIGS. 3 and 4 which includes the base 105, the vertical mast member 110, and the vertical outer lower guide tubes 111. Vertical, horizontal and angular brace members 134, 135 and 140 are interconnected on the base 105 for support of the work platform 104. The forward ends of the horizontal braces 135 are each connected with a sleeve 141 secured on the adjacent guide tube 111. A guy wire bracket 142 and a work platform bracket 143 are secured on each of the sleeves 141 for connection of the lower ends of guy wires on each of the frame assembly and the back opposite side corners of the work platform. A work platform mounting bracket 144 for connection of brace members from the work platform is secured on each side of the back of the frame assembly on each of the vertical braces 134. A flanged pipe guide sleeve 145 is secured vertically through the forward corner of the base 105 for connection of the lower slip assembly 114 below the base and a snubbing pipe guide assembly 150 as shown in FIGS. 1B, 1C, and 15. A guard rail assembly 151 is mounted on the bottom of the base 105 to protect the portions of the hydraulic connections which project downwardly from the power assembly 102 when the frame assembly and power assembly are coupled together in operating relationship. The upper ends of the mast member 110 and the lower guide tubes 111 are secured together and braced by a framework 152 which includes horizontal, vertical, and angular members interconnected as evident in FIGS. 3, 4, 5, and 8. As seen in FIGS. 3 and 4 handling brackets 153 are mounted along opposite sides of the top framework 152. The brackets 153 are each provided with a series of horizontally spaced holes so that the handling cables may be connected at different locations depending upon the location of the center of gravity of the main frame when handling the main frame from a crane during erection and dismantling of the apparatus. A guy wire sheave 154 is mounted along each lower side horizontal frame member as seen in FIGS. 5 and 8 for guy wires used to brace the main frame. An extensible guy wire spar 155 supporting another guy wire sheave 160 is mounted along each lower side framework member as seen in FIGS. 5 and 8. The spar telescopes into the horizontal frame member to which it is connected when not in use. When in use as shown in FIG. 5 the spar telescopes horizontally outwardly and is locked in position by a pin 161.

Referring to FIG. 3, a power cable anchor 162 is secured along the front edge of the mast member 110 for anchoring both of the power cables 125 with the mast member. The anchor is provided with an anchor pin hole 163. An anchor pin storage bracket 164 is secured on each side of the upper end portion of the frame member 110 in the vicinity of the anchor 162 to store two anchor pins for use by the erector of the apparatus when anchoring the power cables to the frame member. Only one pin is used for anchoring while the other is a spare. Two brackets are provided so that the spare and the pin to be used for anchoring may both be stored when the apparatus is disassembled.

As seen in FIG. 4, a hydraulic hose bracket 165 is mounted along the upper end of one of the guide tubes 111 for hoses, not shown, which extend to the traveling slip assembly and related structure.

Figure 10:
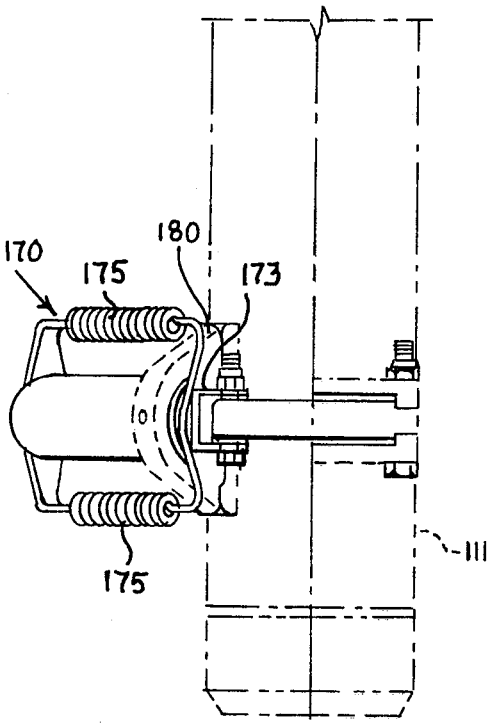
FIG. 10 is a side view in perspective of one of the extensible guide tubing latch assemblies.
Figure 11:
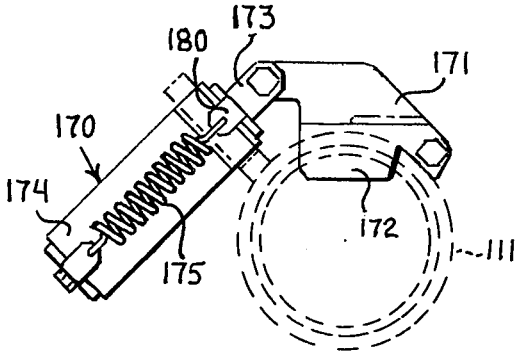
FIG. 11 is a top view of the latch assembly of FIG. 10.
Figure 9:
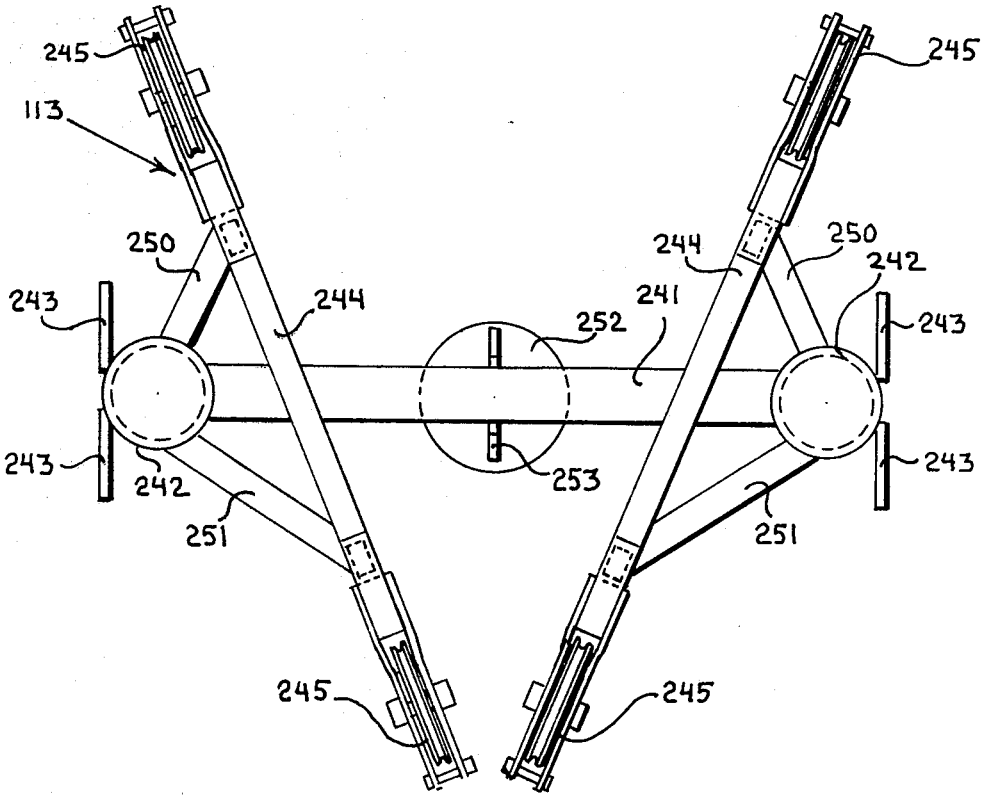
FIG. 9 is an enlarged top view of the crown assembly on the tubes of the main frame assembly.

The telescoping upper guide tubes are held at the upper extended positions by a remotely controllable latch assembly 170 mounted as shown in FIG. 5 near the upper end of each of the lower guide tubes 111 and shown in enlarged detail in FIGS. 10 and 11. Each of the telescoping upper inner guide tubes has a horizontal slot, not shown, located along the length of the tube to hold the tube at the fully extended upper end position when engaged by the latch assembly 170. Referring to FIGS. 10 and 11, each latch assembly 170 includes a latch plate 171 which is pivotally mounted along the outside of the guide tube 111 and provided with a locking lug 172 which is insertable through a horizontal slot provided in the tube 111 into a corresponding horizontal slot in the inner upper guide sleeve 112 telescoped into the lower guide sleeve. The outer end of the lock plate is pinned to a bracket 173 connected on the piston rod of an air cylinder 174. A pair of springs 175 are secured along opposite sides of the air cylinder between the base end of the air cylinder and a bracket 180 connected with the extendible end of the air cylinder piston at the bracket 173. The springs 175 bias the pivoted lock plate 171 inwardly to the lock position shown in FIG. 11. When the air cylinder is supplied with air under pressure the piston extends pivoting the lock plate 171 clockwise to the release position at which the locking lug 172 is retracted outwardly from the locking slot in the inner upper guide tube so that the guide tube is released to telescope downwardly to the collapsed position.

Figure 12:
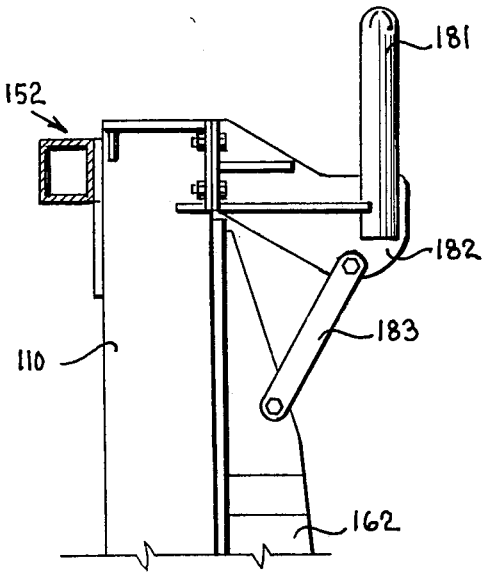
FIG. 12 is a fragmentary side view of the upper guide rod on the main frame assembly for alignment of the power assembly during erection of the apparatus.
Figure 14:
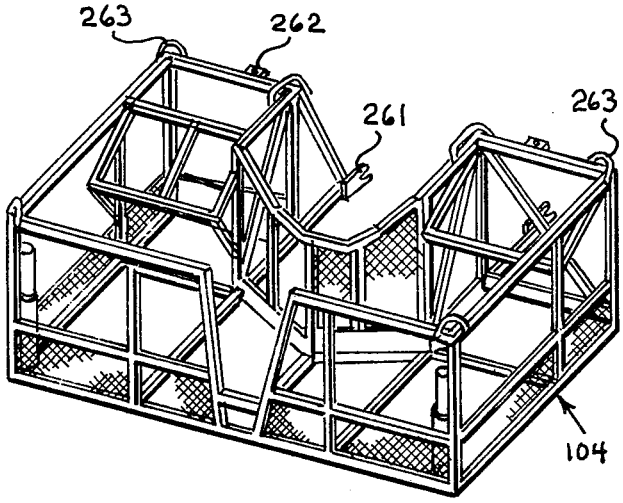
FIG. 14 is a perspective view of the work platform of the apparatus.
Figure 13:
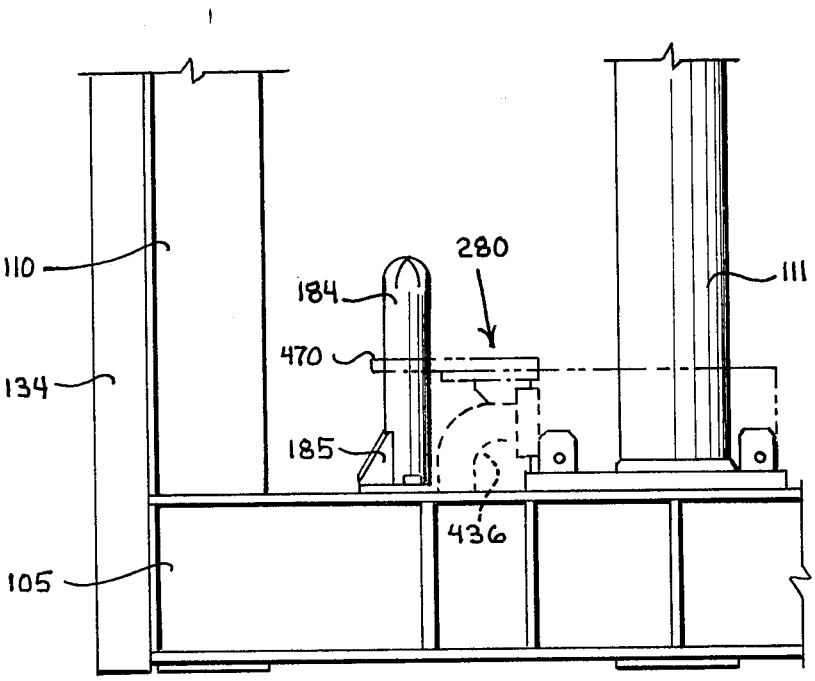
FIG. 13 is a fragmentary side view in elevation illustrating the lower guide rod on the main frame base used in alignment of the power assembly with the main frame assembly during erection of the apparatus.
Figure 16:
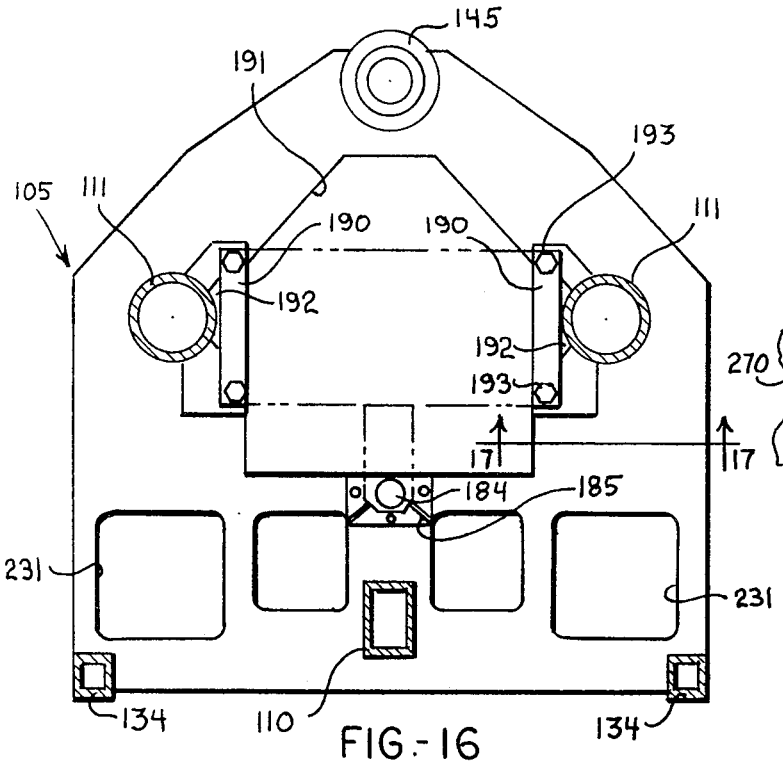
FIG. 16 is a top view of the base of the main frame assembly showing the rigging guides including the lower guide rod and the side guide plates used for directing the lower end of the power assembly onto the base of the main frame assembly.
Figure 17:
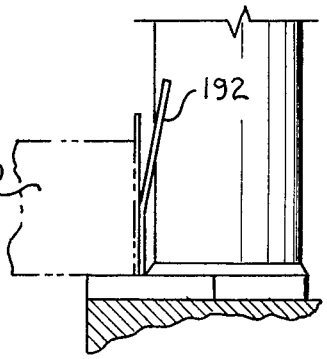
FIG. 17 is an enlarged fragmentary view along the line 17—17 of FIG. 16.

FIGS. 12 and 13 illustrate guide structure used for guiding the power assembly 102 to the proper position for securing with the main frame assembly 101 during erection of the apparatus. Referring to FIG. 12, an upper guide rod 181 is mounted on a bracket 182 secured to the front face of the upper end portion of the mast member 110 and connected by a strut arm 183 with the power cable anchor 162. Referring to FIG. 13, a lower guide rod 184 is secured on a bracket 185 mounted on the top of the main frame base 105. The lower guide rod 184 may be seen from the top in FIG. 16 as located substantially at the center of the frame base 105. Other features of the main frame base as shown in FIG. 16 aid in guiding the power assembly into proper position on the main frame assembly. As seen in FIGS. 16, a pair of guide plate assemblies 190 are secured on the top surface of the main frame base 105 on opposite sides of an opening 191 in the base at the lower ends of the lower guide tubes 111. The guide plate assemblies 190 include integral vertical downwardly and inwardly inclined guide plates 192 fitted on the inside face of the guide tubes 111 for guiding the valve block of the power assembly into position in the frame base when erecting the apparatus. The guide plate assemblies 190 also include threaded bores 193 to receive bolts on the valve block of the power assembly to secure the base end of the power assembly with the frame base.

Figure 18:
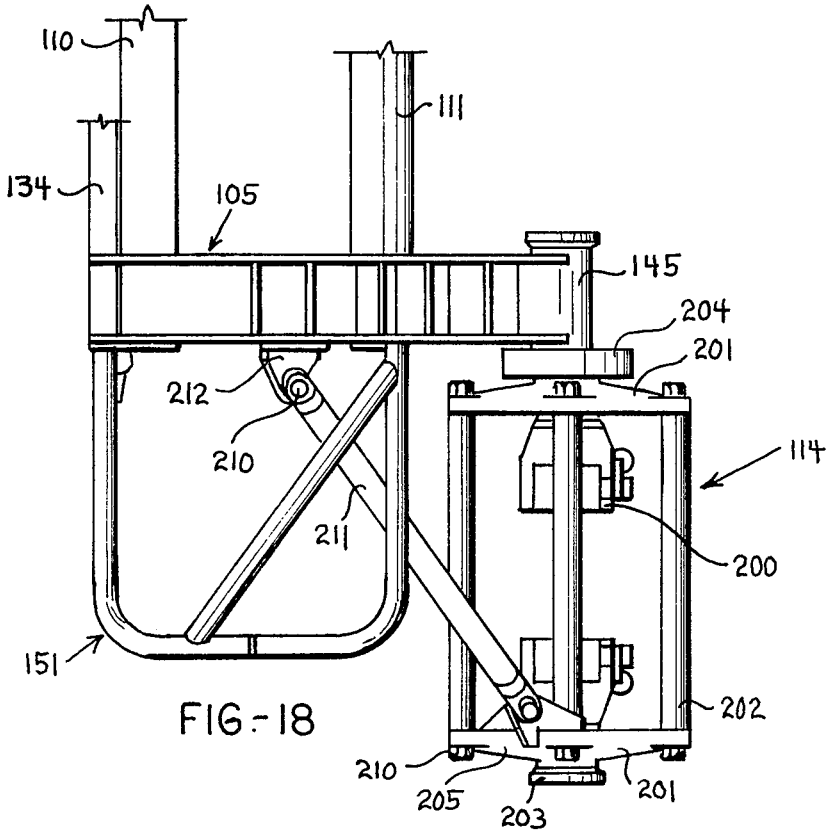
FIG. 18 is a fragmentary side view in elevation showing the base of the main frame assembly and the fixed slip assembly.

Referring to FIGS. 18 and 19, the lower slip assembly is removably connected with the bottom of the main frame base. The fixed slip assembly 114 includes upper and lower conventional type power slips 200 mounted in a frame formed by upper and lower plates 201 secured together by four circumferentially spaced tubular members 202. Each of the plates 201 has an integral mounted flange 203. The slip assembly is supported from the flanged sleeve 145 by a removable clamp 204 which fits around the lower flange on the sleeve 145 and the flange 203 on the upper plate 201. The lower flange plate 201 is similarly connectible with a clamp 204 to a mounting flange on a wellhead. A pair of ear lugs 205 are secured on the top face of the lower plate 201 for connection by removable pins 210 to a brace arm 211 which is connected at the opposite end by another removable pin 210 with a lug bracket 212 mounted on the bottom of the main frame base 105. As evident in FIG. 19, the relative positions of the lugs 205 on the lower plate 201 and the brackets 212 on the bottom of the base 105 positions the brace arms 211 to slope upwardly and outwardly toward the rear of the base so that the base is fully supportable on the fixed slip assembly when the slip assembly is mounted on a wellhead. The design and sizing of the slip assembly and brace arm arrangement permits the entire tubing handling apparatus to be mounted on a wellhead without the need for additional bracing or other base supports. A pair of ball socket assemblies 213 are mounted on the bottom of the back portion of the base 105 for connection of additional braces if desired as illustrated in FIG. 1B. The mounting arrangement between the fixed slip assembly and the main frame base illustrated in FIGS. 18 and 19 permits the disconnection of the tubing handling apparatus from a wellhead in the event of a malfunction of the apparatus while supporting a tubing string in a well bore by means of the fixed slip assembly. The slip assembly is left attached to the wellhead while the tubing handling apparatus is disconnected from the slip assembly at the arms 211 and the clamp 204.

FIGS. 32–36 illustrate the winch assemblies mounted on the main frame base for handling the cable used to manipulate pipe sections between the tubing handling apparatus and nearby pipe storage facilities. Referring to FIGS. 32–34, a pair of winches 220 are mounted in spaced relation on the bottom of a cross member 221 which is securable across the bottom of the back portion of the frame base 105 as illustrated in FIG. 1B. Each of the winches is directly coupled with a hydraulic motor 222 adapted to rotate the winch. The hydraulic motors are each connected with a hydraulic fluid supply manifold 223 and a return manifold 224. Each of the manifolds 223 has a quick disconnect fitting 225 for connection of a suitable source of hydraulic fluid pressure, not shown. The return manifolds 224 connect with a common return quick disconnect fitting 230. As evident in FIGS. 33 and 34 the winches are mounted in vertical displaced relation to the supporting member 221 so that each of the winches may feed and take up vertically upwardly. The winches are located so that the cable handled by each of the winches passes through openings 231 in the frame base 105, FIG. 16. As shown in FIGS. 35 and 36, a pair of cable guide assemblies 232 are mounted on the top of the frame base 105 over the openings 231. Each of the guide assemblies 232 is positioned to direct a cable to and from the winch 220 located below the guide assembly. Each of the guide assemblies is mounted on a plate 233 bolted on the top face of the frame base 105. The guide assemblies include a pair of laterally spaced rotatable rods 234 which lie in the same horizontal plane and a pair of upper and lower rotatable rods 235 which are positioned above and below the rods 234 and displaced in different vertical planes along the length of the rods 234. Looking downwardly on the guide assemblies 232 as seen in FIG. 36 the arrangements of the pairs of guide rods 234 and 235 defines a slot 240 through which a pipe handling cable passes between the mast assembly above and the winch 220 immediately below the guide assembly.

Figure 6:
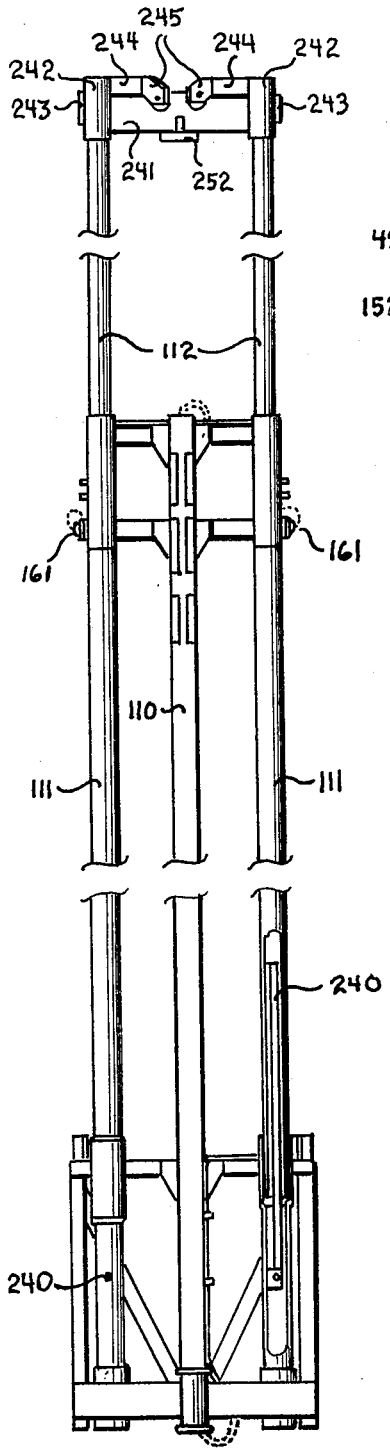
FIG. 6 is a broken front view in elevation of the main frame assembly shown in FIG. 5.

The upper inner guide tubes 112 are sized in diameter and length to telescope into the lower outer guide tubes 111 to lower end positions at which sufficient length of the upper inner guide tubes extends above the upper ends of the lower outer guide tubes to permit the connection of the upper sheave assembly 123 of the power assembly 102 when assemblying the frame assembly and power assembly when erecting the apparatus. Referring to FIG. 6, a tubular stop 240 is installed through the lower end of each of the lower guide tubes 111 and secured by a pin 240*a*. The stops 240 limit the downward movement of each of the inner tubes 112 so that a sufficient length of each of the inner tubes will extend above the upper ends of the outer tubes to permit the sheave assembly connection as stated. The upper ends of the upper guide tubes 112 are connected together by the crown assembly 113 as shown in detail in FIGS. 5, 6, 8 and 9. The crown assembly includes a horizontal cross member 241 connected between caps 242 which fit over the upper ends of the tubes 112 for securing the crown assembly on the tubes. A pair of guy wire brackets 243 is mounted along the outer side of each of the caps 242 for connection of guy wires to brace the upper tubes when extended. A pair of sheave brackets 244 is mounted on the top of the cross member 241. Each of the brackets 244 supports sheaves 245 mounted at opposite ends of the brackets. The sheave brackets are secured at angles with the cross members so that the brackets converge to close spaced relationship at the front of the crown assembly so that the cables which run over the sheaves will each be aligned close to the line of movement of the travelling slip assembly 130. Angular braces 250 and 251 are connected between the sheave members 244 and the caps 242. A circular lift plate 252 is secured on the bottom edge of the cross member 241. Braces 253 extend from the top face of the lift plate and the side faces of the cross member 241. The plate 252 is engageable by the top of the sleeve 133 on the upper end of the piston assembly 122.

The removable work platform 104 is formed of suitable vertical, horizontal, and angular members defining an elevated, protected topless work area having a metal grating floor and expanded metal side walls. The platform is provided with mounting brackets 261 and 262 for securing the platform to the mast assembly. Each of the upper corners of the platform has a handling loop 263 for connecting cables to the platform for handling during erection and dismantling of the apparatus.

The snubbing pipe guide assembly 150 as illustrated in detail in FIG. 15 is a telescoping assembly for holding pipe against buckling when forcing the pipe downwardly into a well under pressure. The snubbing assembly is formed of a plurality of tubular members nested together in concentric relationship. The members are arranged to sufficiently overlap when fully extended to minimize lateral flexing of the assembly for maximum pipe support. The innermost tubular member 270 is secured at a lower end with an annular flange 271. The outermost tubular member 272 is secured at an upper end with an upper flange 273. Opposite ends of adjacent nested tubes in the assembly have inner and outer annular retainer flanges which engage each other when the tubes are fully extended to retain the tubes in the nested relationship while permitting the assembly to telescope to a maximum extension length and to telescope together to a minimum length as seen in FIG. 15. The lower flange 271 clamps to the upper flange of the guide sleeve 145 on the main frame base 105. The upper flange 273 of the assembly 150 clamps to the lower pipe slip assembly of the traveling slips 130 so that the traveling slips may be raised and lowered with the assembly 150 extending and contracting to provide lateral stability to the section of the pipe being snubbed between the traveling slips and the wellhead.

The ladder assembly 103 is removably connectible with the mast member 110 of the main frame assembly by brackets 288. The ladder assembly includes vertical side members 281, horizontal longitudinally spaced ladder rungs 282, and a protective cage extending over a major portion of the length of the assembly formed by vertical members 283 secured with semi-circular horizontal members 284 secured at opposite ends to the side members. The ladder provides personnel access to the portion of the apparatus structure in the vicinity of the upper end of the fixed mast 110.

Figure 20:
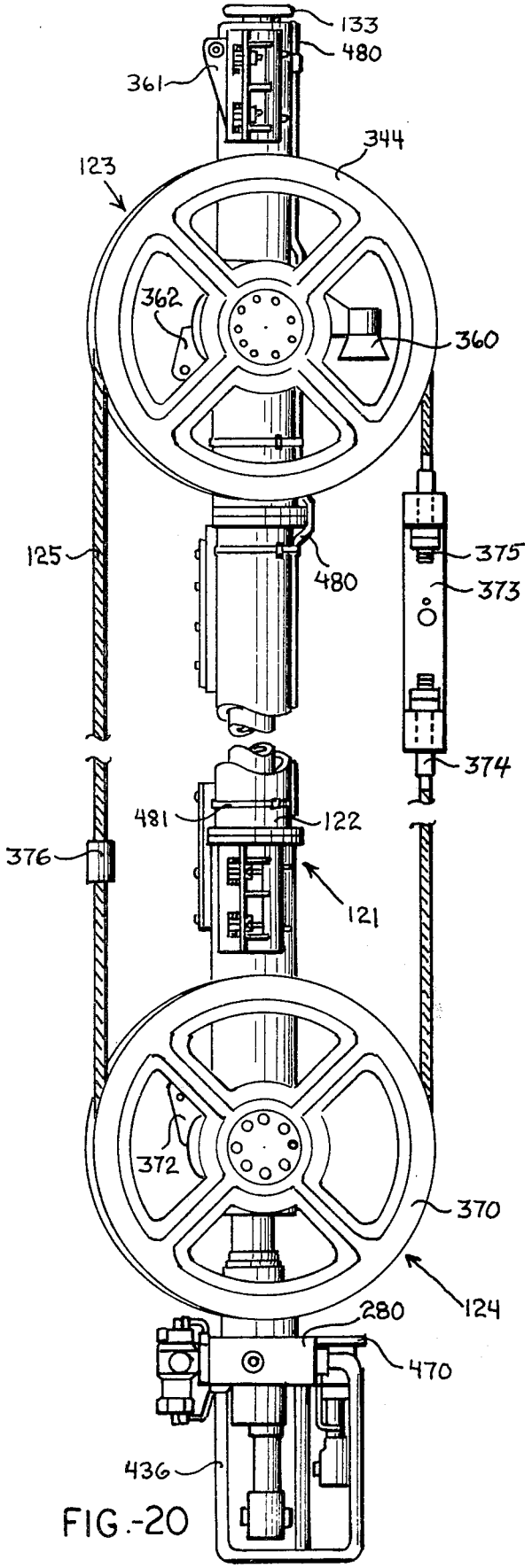
FIG. 20 is a broken side view in elevation of the power assembly of the apparatus including the sheaves, power cables, and valve block on the lower end of the hydraulic cylinder assembly.

The power assembly 102 which is used for lifting and lowering tubing strings in well bores and for forcing or snubbing tubing strings into well bores against well pressure is illustrated in detail in FIGS. 22–23, 24, 25, 30 and 31. Referring to FIG. 20, the power assembly includes the hydraulic cylinder assembly 121, the upper sheave assembly 123, the lower sheave assembly 124, the power cable assemblies 125, the traveling block assembly 130, and a valve block 280 secured with the lower end of the hydraulic cylinder assembly providing a mounting for the power assembly on the frame base 105 and for communication with the power assembly from a suitable source of hydraulic fluid pressure for operating the cylinder assembly during lifting and snubbing and the slip assemblies for gripping the pipe during operation of the apparatus.

Referring to FIGS. 31A–31D, the hydraulic cylinder assembly 121 includes the outer hydraulic cylinder housing 122 which is longitudinally movable on a piston rod assembly 290 which is mounted on a rod flange assembly 291 connectible to the valve block 280. The upper end of the cylinder housing 122 is closed by a plate 292. A cushion cylinder 293 is secured at an upper end and to the bottom face of the closure plate 292 and fits in closely spaced concentric relationship around the upper end portion of the piston rod assembly 290. An annular cylinder head 294 and a cylinder head cap 295 are secured in the lower end of the cylinder housing 122 around the piston rod assembly. The cap 295 threads into the lower end of the cylinder housing and carries an internal annular seal to seal between the cap and the outer surface of the piston rod. The cylinder head 294 is retained in the housing by the cap and has an external annular lower end flange which engages an internal annular recess within the lower end of the cylinder housing. Internal and external seals carried by the head 294 seal with the inside wall of the cylinder housing and the outer wall of the piston rod assembly. Longitudinally spaced external annular mounting flanges 296 and 297 are secured on the cylinder housing for mounting the upper and lower sheave assemblies 123 and 124 respectively. The piston rod assembly 290 includes an outer tube 300 threaded along a lower end portion into a mounting sleeve 301 which is secured into the top face of the flange assembly 291. The piston rod 300 has a reduced upper end 302 which is welded into the rod 300 providing a supporting flange surface 303 on which an annular piston 304 is supported by a lock nut 305. The piston 304 has external annular piston rings for sealing between the piston and the inner surface of the cylinder housing 122. The cushion sleeve 293 telescopes over the upper end portion of the piston rod end member 302. The lower end of the cushion member 293 is slotted at 310 and engages the top edge of the nut 305 limiting the downward movement of the housing 122 over the piston rod assembly. Between the cylinder housing cap 292 and the piston 304 the housing 122 defines an upper hydraulic fluid pressure chamber 311 which communicates with the central bore through the piston rod assembly around the bottom end of the cushion member 293, between the cushion member and the upper end of the piston rod when the cushion member is telescoped downwardly over the piston rod, and downwardly into the piston rod assembly through the open upper end of the piston rod portion 302. Between the piston 304 and the head 294 the housing 122 and the piston rod define a lower annular hydrualic fluid pressure chamber 312 which communicates through circumferentially spaced ports 313 into an annular flow passage 314 between an inner piston rod tube 315 and the outer main piston rod 300. The piston rod tube 315 is secured into the rod member 302 at an upper end defining the upper end of the annular passage 314 and is secured through the flange assembly 291 at a lower end. Circumferentially spaced tube support members 320 are secured around the tube 315 within the lower end portion of the piston rod 300. The central bore of the tube 315 defines a hydraulic fluid low passage 321 through which hydraulic pressure fluid is directed upwardly through the piston rod assembly into the upper annular pressure chamber 311 through the open upper end of the piston rod member 302. An external annular stop flange 322 is secured on the rod 300 within the lower pressure chamber 312. The lower face of the stop flange 322 is engageable by the upper end of the head 294 limiting the upward movement of the cylinder housing assembly on the piston rod assembly. The flange assembly 291 has a flow chamber 323 closed in the outer end by a cap 324 welded into the flange. A flow port 325 in the bottom of the flange 291 opens into the flange chamber 323. An opening 330 in the top of the flange 291 communicates the chamber 323 around the tube 315 with the annular flow passage 314. The flange assembly 291 has circumferentially spaced bolt holes 331 for securing the flange assembly to the valve block 280. When the flange assembly is secured with the valve block the lower end of the tube 315 communicates with one hydraulic fluid flow passage in the valve block while the port 325 in the bottom of the flange assembly 291 communicates with another separate hydraulic fluid flow passage in the valve block. The hydraulic cylinder assembly is operated to raise tubing by applying hydraulic pressure upwardly through the tube 315 within the central flow passage 321, outwardly from the upper end of the piston rod portion 302, downwardly around the rod portion 302 in the space between the rod portion and the cushion sleeve 293 and outwardly through the slots 310 in the lower end of the cushion sleeve into the upper chamber 311. Since the piston rod assembly is secured with the valve block 280 by means of the flange assembly 291 the piston rod assembly cannot move upwardly. Thus, hydraulic fluid pressure in the upper chamber 311 lifts the cylinder housing 122 upwardly on the piston rod assembly since the lower end of the upper chamber 311 is closed by the fixed piston 304 secured on the piston rod assembly. When the hydraulic pressure is released the housing 122 returns downwardly. When the cushion sleeve 293 telescopes downwardly over the piston rod portion 302, the return of hydraulic fluid from the chamber 311 into the central flow passage 321 is restricted to the space between the cushion sleeve 293 and the piston rod end portion 302 so that a cushion effect occurs operative over a distance equal to the length of the cushion sleeve providing a shock absorbing effect at the lower end of the stroke of the power assembly. The cylinder housing 122 may be forced downwardly for snubbing pipe sections in the well bore by applying hydraulic fluid pressure from the valve block into the port 325. The pressure is communicated through the flange chamber 323, upwardly through the opening 330 in the flange assembly 291 into the annular chamber 314 between the piston rod 300 and the inner tubing 315 within the rod. The fluid pressure is transmitted outwardly from the annular flow passage 314 and the ports 313 into the lower pressure chamber 312 between the piston rod and the housing 122. The hydraulic fluid pressure downwardly on the head 294 at the lower end of the housing 122 forces the housing downwardly thereby moving the power assembly downwardly. Obviously when hydraulic fluid is forced into the upper chamber 311 fluid within the lower chamber 312 returns through the defined path to the source of hydraulic pressure and when the housing 122 moves downwardly, hydraulic fluid is returned from the upper chamber 311.

As seen in FIG. 31C a vertical mounting bar 332 is secured along the length of the cylinder housing 122 for supporting the anti-torsion guide track 132.

Figure 25:
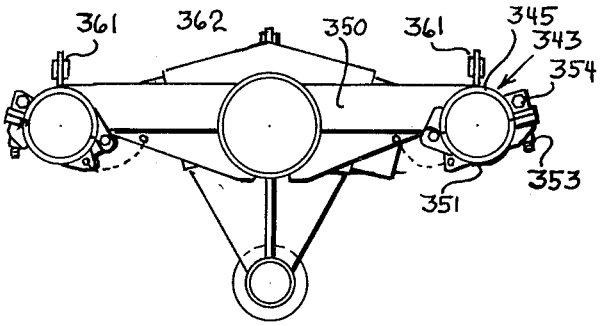
FIG. 25 is a top view of the upper sheave assembly head as seen in FIG. 24.
Figure 24:
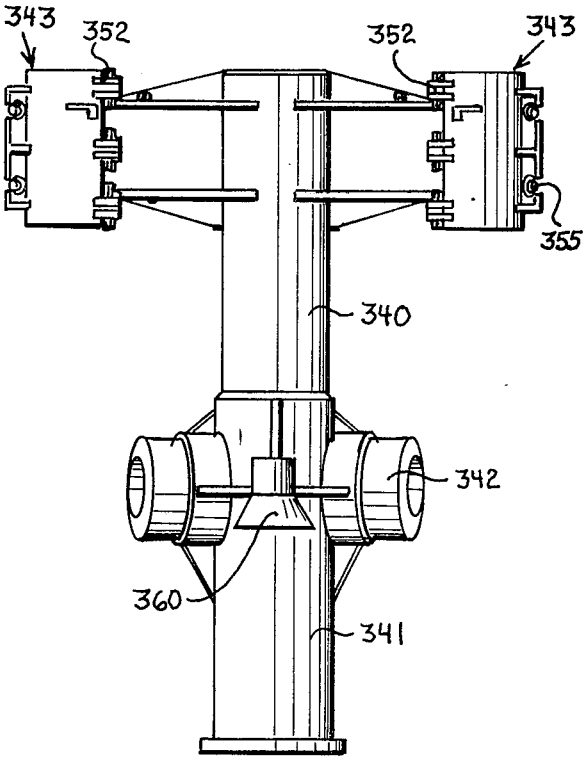
FIG. 24 is a side view in elevation of the upper sheave assembly used.
Figure 26:
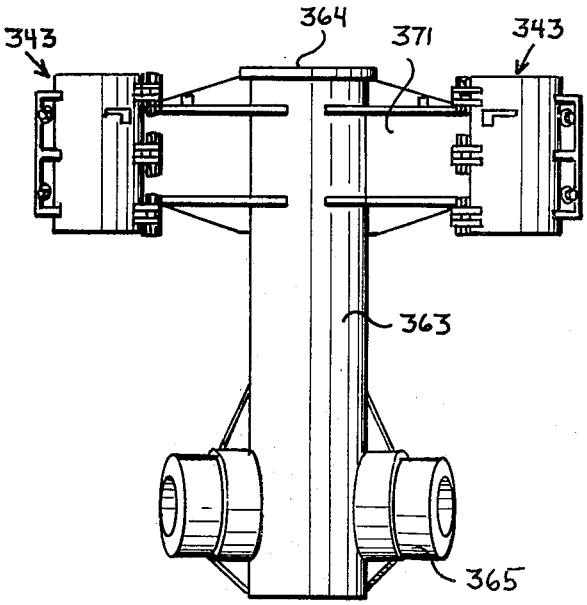
FIG. 26 is a side view in elevation of the lower sheave assembly head.
Figure 22:
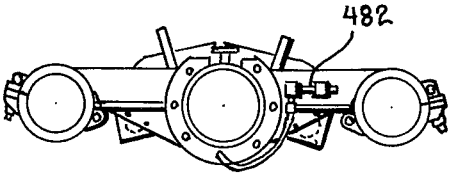
FIG. 22 is a view in section along the line 22—22 of FIG. 21.

Referring to FIGS. 20–25, the upper sheave assembly 123 includes a tubular body 340, a sheave head assembly 341 having sheave hubs 342 mounted on the body, and split sleeve guide tube assemblies 343 secured on the upper end portion of the body. A pair of upper sheaves 344 are mounted on the sheave hubs 342. The lower end of the sheave hub assembly has a flange 345 which connects to the flange 296 on the cylinder housing 122 for mounting the sheave assembly 123 along the upper end portion of the cylinder housing. The sheave hubs 342 are aligned on axes which intersect at an angle positioning the sheaves as best seen in FIG. 1C at an angle which aligns the front portions of the power cables in sufficient spaced relation to permit support of the traveling slips 130 between the cable front portions. Similarly the backs of the sheaves are sufficiently close together that the back portions of the power cables are anchored to the single vertical mast member 110 at the cable anchor 162. The split guide sleeves 343 which slide along the parallel guide tubes 111 each includes a fixed half sleeve 345 secured to a horizontal arm 350 mounted on the body 340 and a movable hinged split sleeve 351 supported along one side by hinges 352. Along the open side of the split sleeve guide assemblies the fixed sleeve 345 has two horizontally pivoted bolts 353 secured on a vertical bracket 354. The hinged split sleeve portion 351 has a vertical latch plate 355 having spaced slots to receive the pivoted bolts 353 when the hinged split sleeve 351 is closed as seen in FIG. 25. Both of the split sleeve guide assemblies 343 on the upper sheave assembly thus open fully so that in mounting the power assembly on the main frame assembly the upper sheave assembly may be swung horizontally to the frame assembly with the split guide sleeves open and when properly aligned the guide sleeves are closed around the guide tubes 111. An alignment funnel 360 is mounted on the sheave hub assembly 341 as seen in FIG. 24. The alignment guide funnel 360 fits on the alignment rod 181 at the upper end of the main frame assembly for aligning the upper end of the power assembly with the upper end of the main frame assembly when mounting the power assembly on the frame assembly. A cable handling bracket 361 is secured along each of the fixed split sleeves 345 and a handling bracket 362 is connected with the body 340 for connection of cables used for supporting and manipulating the power assembly during erection and dismantling of the apparatus.

Figure 27:
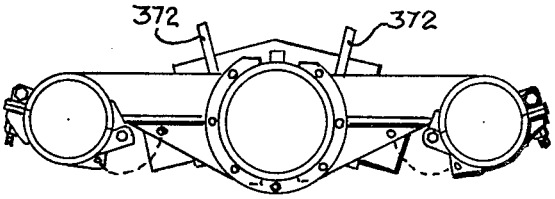
FIG. 27 is a top view of the lower sheave assembly head as seen in FIG. 26.
Figure 23:
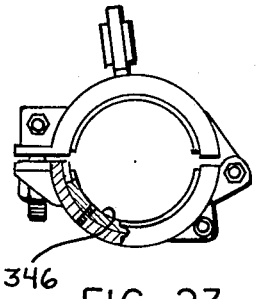
FIG. 23 is a top view of one of the split guide bearings on the sheave assemblies as seen along the line 23—23 of FIG. 21.

Referring to FIGS. 20–22, 26, and 27, the lower sheave assembly 124 includes a tubular body 363 having an upper end flange 364 for securing the lower sheave assembly with the flange 297 on the hydraulic cylinder assembly housing 122. A pair of sheave hubs 365 are secured at an angle on the body 363 along the lower portion of the body for supporting a pair of lower sheaves 370 at the same angles as the upper sheaves for holding the lower ends of the power cables 125. Split sleeve guide assemblies 343 are mounted on arms 371 at the upper end of the body 360 for connection of the lower sheave assembly with the guide tubes 111. The construction of the split sleeve guide assemblies 343 is identical in the lower sheave assembly to the previously described guide assemblies 343 of the upper sheave assembly. A pair of handling brackets 372 are connected with the cross arms 371 of the lower sheave assembly as seen in FIG. 27 for the connection of handling cables to the lower portion of the power assembly during erection and dismantling. As shown in FIG. 23, each of the split sleeve guide tube assemblies 343 on the sheave assemblies includes an internal bearing sleeve 346 made of a material such as nylon to provide a smooth bearing surface along which the guide assembly engages the guide tubes 111.

Each of the power cables 125 has opposite ends connected with an anchor link 373, FIG. 20, connected with the cable ends by means of fittings 374 fitted on the opposite ends of the cables and having threaded end portions secured by nuts 375 with the anchor link. The anchor links of each of the cables are secured with the anchor 162 on the main frame member 110 by a pin 374*a*. The two power cable links 373 fit along opposite sides of the main frame cable anchor 162 with a single pin 374*a* holding both of the cable anchor links to the cable anchor on the frame member. The front portion of each of the power cables has a sleeve 376 which is crimped on the cable for connection of the cable with the guide yoke 131 illustrated in detail in FIGS. 28–30. Referring to FIG. 28, the guide yoke includes a body 380 having end portions 381 each supporting a guide tube roller assembly 382 and forwardly extending arms 383 each supporting a cable clamp assembly 384 and traveling slips support pin assemblies 385. An anti-torsion guide shoe assembly 390 is secured at the back center of the yoke body. Each of the roller assemblies includes a roller 391 mounted on a shaft 392 supported by a frame 393 held by bolts 394 on the end portions of the yoke body. The anti-torsion guide shoe 390 is mounted on a spherical bearing 395, FIG. 30, supported on a bolt 400 secured through the yoke body 380. The guide shoe has a longitudinal guide slot 401 which couples the guide shoe with the guide track 132 along the front face of the hydraulic cylinder housing 122. Each of the cable clamp assemblies 384 includes hollow shell members 402 and 403 secured together by bolts 404. The sleeve 376 on the front portion of the power cable 125 is clamped in the vertical bores defined between the members 402 and 403 for coupling the arms of the yoke assembly 131 with the two power cables 125. Each of the swivel mounting pin assemblies 385 is held with the arm 383 by a quick release pin 405. Each of the mounting pin assemblies 385 includes a bolt assembly 410 for securing the pin assembly with a traveling slip support apparatus shown in detail in FIGS. 37–40.

Referring to FIGS. 37–40, an assembly 411 for supporting the traveling slip assembly 130 with the yoke 131 includes parallel spaced plates 412 secured in parallel spaced relation with lug members 413 each of which is bored to provide mounting sockets 414 for the pin assemblies 385 of the yoke 131. Braces 415 are secured between the top plate 412 and the lugs 413. Web plates 420 are secured between the plates 412 on opposite sides of a pair of spaced plates 421. The lugs 413 have lateral aligned holes 422 for the bolts 410 on the pin assemblies 385 to hold the pin assemblies engaged with the traveling slip support apparatus. Bolt assemblies 422 are provided in the upper and lower plates 412 for securing traveling slips with the slip support assembly. The plates 412 have central openings 423 for the passage of pipe sections supported through the traveling slip assemblies on the support apparatus.

FIGS. 41–43 show the valve block assembly on which the hydraulic cylinder assembly 122 is mounted for supporting and supplying hydraulic fluid under pressure to the cylinder assembly and for mounting the power assembly 101 on the frame base 105. FIG. 43A illustrates the hydraulic system of the valve block assembly which is a conventional regenerative circuit with counterbalance valves for load control. Referring to FIG. 41, the valve block assembly includes a body 430 provided at the four corners of the body with captured bolts 431 for securing the body with the threaded members 193 as illustrated in FIG. 16 in the base 105. The body has a central flow port 432 which communicates with the flow passage 321 in the cylinder assembly and a flow port 433 which communicates with the flow port 325 of the cylinder assembly. Threaded bolt holes 434 are provided for securing the plate assembly 291 of the hydraulic cylinder assembly on the top face of the body 430. The lower end portion of the piston tube 315 as seen in FIG. 31A extends downwardly into flow port 432. A ring seal 435 is positioned within the body 430 around the port 432 to seal with the extended lower end portion of the tube 315. When the block 291 is assembled on the body 430 a ring seal, not shown, is positioned in a seal recess around the opening 325 of the block for sealing with the top surface of the body 430. A guard tube assembly 436 is secured with a side and the bottom of the body 430 to protect the hydraulic lines and related apparatus. The assembly 436 is secured to the body 430 by bottom fittings 437 and side fittings 438. The body 430 is provided with suitable internal flow passages communicating with the ports 432 and 433 and and leading to conduits 432*a* and 433*a* for communication with the ports 432 and 433 to supply hydraulic fluid under pressure as desired to the upper and lower pressure chambers of the cylinder assembly. Referring to FIGS. 43 and 43A, a quick disconnect fitting 440 is provided on the bottom of the valve block leading through a check valve 441 in the conduit 432*a* extending to the valve block port 432 for supplying hydraulic pressure to lift the cylinder housing 122 for raising tubing from a well bore. A quick disconnect fitting 442 is provided on the bottom of the valve block leading to a check valve 443 in the line 433*a* in extending to the valve block port 433 which leads to the piston rod end of the cylinder assembly 121 for moving or retracting the traveling slips downwardly. A quick disconnect fitting 444 is provided on the bottom of the valve block leading to a conduit 446 connected to suitable flow passages in the valve block as seen in FIG. 43A for return of hydraulic fluid from either end of the hydraulic cylinder assembly when lifting and when snubbing. A pair of counterbalance valves 445 are provided connected with the lines 432*a* and 446 between the port 432 and the return fitting 444 to permit hydraulic fluid flow return from the cylinder end of the assembly 121 when the cylinder is moving downwardly. Similarly, a counterbalance valve 450 is provided in the line 446 between the fitting 444 and the port 433 in the valve block for hydraulic fluid return from the piston end of the hydraulic assembly 121 when the cylinder 122 is being lifted. A two-way valve 451 is connected in a line 449 leading to both the ports 432 and 433 to permit hydraulic fluid flow between the cylinder and piston ends of the assembly 121 during a regenerative mode of operation of the cylinder assembly. A quick disconnect fitting 452 connects with the portion of the system supplying hydraulic pressure for snubbing and is adapted for connection with the control console, not shown, on the work platform for indicating weight on the traveling slips during the snubbing mode of operation. Similarly a quick disconnect fitting 453 communicates with the lifting portion of the hydraulic system and is connectible to an indicator on the console for showing weight on the traveling slips during lifting. A quick disconnect coupling 454 is provided connected through a needle valve 455 to the counter balance valve 450. The quick disconnect fitting 454 is connectible with a control on the console. A quick disconnect fitting 460 leads to a two-way valve 451 through a needle valve and check valve 461 and is connectible with a control on the console for controlling the two-way valve 451. A needle valve 462 is provided in a pilot line between the counterbalance valves 445 and the two-way valve 451. A quick disconnect fitting 463 leads to the pressure supply for the lifting mode and is connectible to the control console into a control valve connected at the console with the lines leading from the quick disconnect fittings 454 and 460 for supply control signals to the fittings 454 and 460 from the console. The quick disconnect fittings 440, 442, and 444 are all connectible to a suitable source of hydraulic fluid pressure, not shown, including a pump and a reservoir which may be any available standard equipment capable of delivering a sufficient quantity of hydraulic fluid at the desired pressure for operating the hydraulic cylinder assembly. The hydraulic controls on the console at the work platform also are of standard design comprising no part of the present invention.

Figure 21:
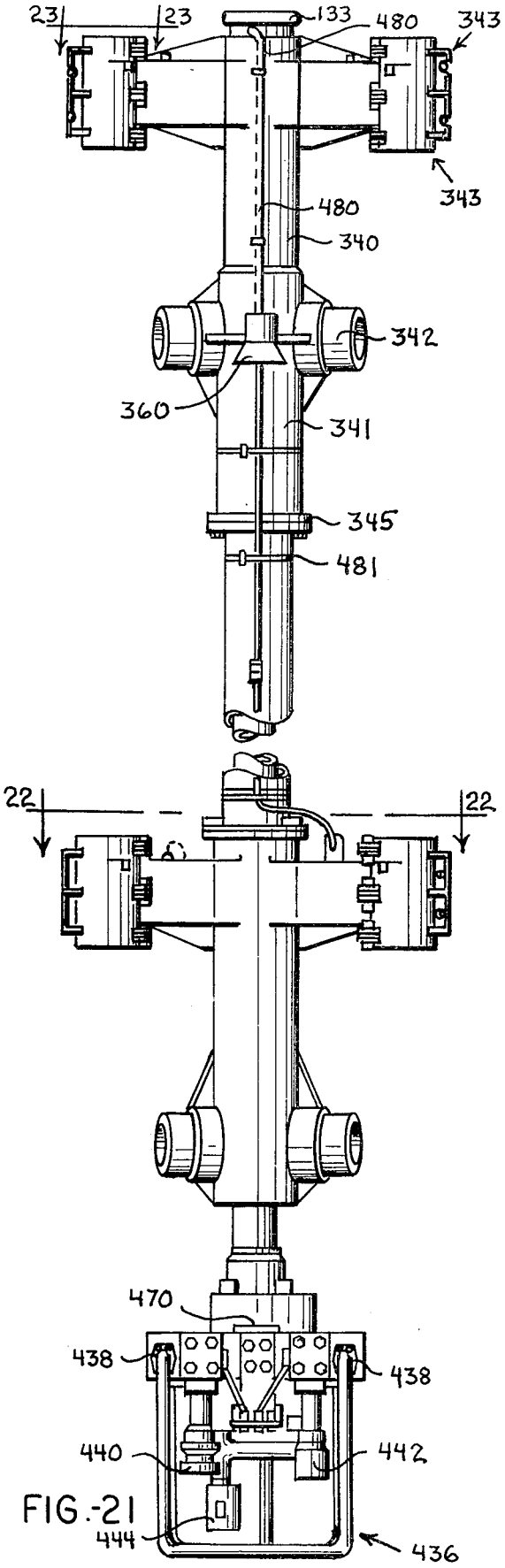
FIG. 21 is a broken front view in elevation of the structure shown in FIG. 20 with the sheaves and power cables removed to illustrate the sheave mounting and guide assemblies.

A lower rigging guide plate 470 is secured with the valve block assembly as shown in FIGS. 20, 21, and 43 provided with a bore, not shown, aligned to receive the guide rod 184 on the main frame base 105 in the relationship shown in FIG. 13 which illustrates the guide plate in phantom lines engaged on the guide rod.

The inflatable sleeve 133 is an extendible rubber type element sometimes referred to as an air stroke actuator sold by Firestone Rubber Company under the part No. NAD 11812. As shown in FIGS. 20 and 21, the air actuator 133 is connected with an air supply line 480 which extends down the hydraulic cylinder housing 122 held to the housing by hose clamps 481 to the lower sheave assembly cross arm 371 where the hose is secured to a fitting 482 for connection of a flexible air line leading to a suitable source of compressed air, not shown, for extending the actuator during erection of the tubing handling apparatus.

Figure 7:
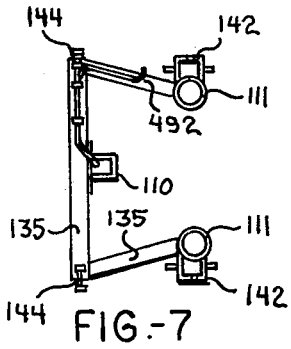
FIG. 7 is a view in section along the line 7—7 of FIG. 5.

Referring to FIGS. 4 and 5, the guide tube latch assemblies 170 are supplied with compressed air through lines 490, FIG. 8, which connect with a line 491, FIG. 5, extending to a fitting 492, FIG. 7, for the connection of a source of compressed air, not shown, to operate the latches during erection of the apparatus.

The mast member 110 may serve as a conduit for air lines, not shown, extending from a source of compressed air through the mast to the bracket 165 at the mast frame 152, FIG. 4, from which the air lines are connected to the traveling slips and a rotary head if used with the slips.

As shown in FIG. 5, the main frame assembly 101 includes self-contained guy wires 500 which may be rigged on the frame assembly before erection of the apparatus. The guy wires 500 each extend from a bracket 243 on the crown assembly 113 over sheaves at the level of the frame 152 to brackets 142 near the base 105 of the frame assembly as better seen in FIGS. 3 and 4. The rear guy wires 500 pass over the sheave assemblies 154. The forward guy wires 500 pass over the sheave assemblies 160 on the extendible strut 155 at each side of the frame assembly outward of the guide tubes 111. As shown in FIGS. 3 and 4, the frame assembly 152 of the main frame may include a bracket 501 for external guy wires 502, FIG. 1A, which are used if necessary to provide extra stability to the frame assembly during operation.

As represented in FIGS. 1B and 1C, cables 510 are normally connected over the sheaves on the crown assembly 113 through the cable guide assembly 120 on the frame base 105 to the winch 115 below the frame base. Two cables are employed on each side of the handling apparatus one extending from each of the winches 115. The free end of each of the cables 510 is connected with a tubing pickup assembly or elevator 511. The cables 510 and elevators 511 are normally rigged on the frame assembly before erection of the apparatus to prevent the necessity of personnel having to climb to the top of the frame assembly before the assembly upper guide tubes 112 are extended to upper operating positions.

In accordance with a principal feature of the invention, the tubing handling apparatus 100 is normally transported and otherwise handled in the previously described subassemblies including the frame assembly 101, the power assembly 102, the ladder 103, and the work platform 104. The frame assembly includes the upper and lower guide tubes telescopically coupled together, the crown assembly 113, the base assembly 105, and the lower fixed slips 114 together with related structures such as the guy wires 500 and the handling cables 510 connected with the winches 115. The power assembly includes the hydraulic cylinder assembly 121, the upper and lower sheave assemblies 123 and 124, the valve block 280, the power cables 125, and the traveling slips 130 mounted on the yoke 131 which is connected on the cables 125. It will be apparent that the yoke and traveling slips may be handled separately but may be secured on the cables if desired during erection of the apparatus. By handling the apparatus in such subassemblies the heaviest of the subassemblies does not exceed the maximum capacity of available helicopters so that the apparatus may be transported to and erected by helicopter if conditions require such as on certain offshore wells. If desired the frame assembly and power assembly may be secured together and transported as a unit which is erected on a wellhead generally as represented in FIG. 2.

Figure 2:
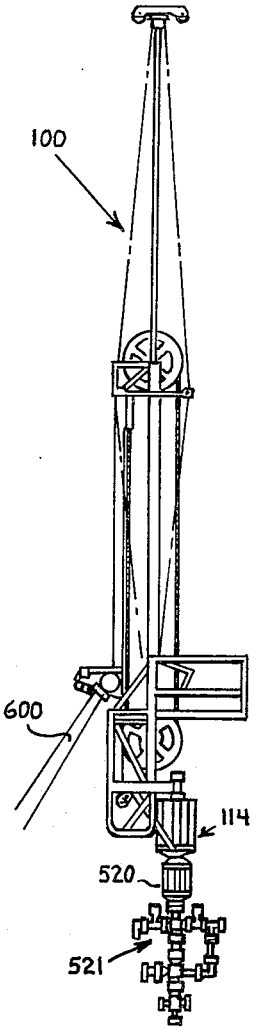
FIG. 2 is a side view in elevation showing the mounting of the tubing handling apparatus on a wellhead with an erecting crane and the guide tubes of the frame assembly fully extended.

When handling the tubing apparatus 100 in the four defined subassemblies, the frame assembly 101 is first installed on a wellhead by raising the frame assembly to a vertical position and aligning the bottom flange 203 on the fixed slip assembly 114 with a wellhead flange such as the flange 520 on the wellhead 521 shown in FIG. 2. The flange 203 is clamped to the wellhead flange 520 by a clamp such as the clamp 204 which surrounds and holds the flanges together. When the frame assembly is mounted on the wellhead the upper inner guide tubes 112 are collapsed as generally shown in FIG. 1C at which positions the lower ends of the guide tubes 112 engage the bottom stops 240 mounted within the lower end portions of the outer lower guide tubes 111. Such positions of partial extension hold the guide tubes 112 sufficiently above the upper ends of the guide tubes 111 for the guide sleeves on the upper sheave assembly 123 of the power assembly 102 to be clamped around the upper guide tubes when the power assembly is mounted on the frame assembly.

The next step in the erection of the tubing handling apparatus 100 is the mounting of the power assembly 102 on the frame assembly 101. The power assembly is cable supported such as from the brackets 362 and 372 by a suitable lifting apparatus such as a crane. The power assembly is manipulated to a vertical position at which the guide funnel 360 on the upper sheave assembly at the back side of the power assembly and the rigging guide plate 470 on the back side of the valve block 280 at the lower end of the power assembly are aligned slightly above the upper rigging guide bar 181 at the upper end of the front of the frame assembly and the lower rigging guide bar 184 on the base 105 of the main frame assembly. The power assembly is swung into the main frame assembly and lowered telescoping the funnel 360 down over the upper rigging guide bar 181 and the guide plate on the valve block downwardly on the lower rigging guide bar 184. The sides of the valve block 280 on the lower end of the power assembly are manipulated downwardly between the guide plates 192, FIG. 16, between the lower end portions of the lower guide tubes 111. The coaction between the upper rigging guide bar 181 and the power assembly funnel 360 and the lower rigging guide bar and the power assembly valve block plate 470, along with the guiding effect of the guide plates 192 directs the valve block to a seated position on the top of the main frame assembly 105 at which the captured bolts 431 in the valve block assembly may be threaded into the internally threaded bores 193, FIG. 16, of the main frame base 105. The bolts 431 are tightened to secure the valve block assembly with the main frame base. The power cable anchor links 373 are properly aligned on opposite sides of the anchor 162 on the front face of the main frame mast member 110. The anchor links lie along opposite sides of the anchor. The pin 374 is inserted through the anchor links and the anchor pinning the anchor links to the anchor thereby locking the back sides of the power cables to the mast member 110 at the anchor 162. It will be recognized that during the procedure of swinging the power assembly into the frame assembly and aligning the power assembly for proper seating in the frame assembly, the split guide tube bearing assembly 343 on the upper sheave assembly 123 and the lower sheave assembly 124 are open so that the fixed sleeve bearing portion 345 of each of the guide tube bearing assemblies may be moved against the front side of the guide tubes. The open bearing assemblies on the upper sheave assembly are fitted to the upper guide tubes 112 above the upper ends of the lower guide tubes. The open guide tube bearing assemblies on the lower sheave assembly are fitted to the lower guide tubes 111. The guide tube assemblies are then closed around the guide tubes swinging the hinged portions 351 around the tubes and securing the hinged guide tube bearings to the fixed bearing portions by the pivoted bolts 353 engaging in the slots of the vertical brackets 355. Thus, the guide tube bearings on the upper sheave assembly slide on the upper guide tubes 112 while the guide tube bearings on the lower sheave assembly slide on the lower guide tubes 111.

The ladder assembly 103 and the work platform 104 may then be mounted as shown in FIGS. 1B and 1C on the main frame assembly.

The various compressed air and hydraulic fluid connections are made including connecting the source of hydraulic fluid to the quick disconnect fittings 440, 442 and 444 on the bottom of the valve block assembly 280.

Compressed air pressure is applied to the air actuator 133 on the upper end of the power assembly hydraulic cylinder through the line 480. The air actuator is extended or expanded upwardly to a normal height of six to eight inches, for example. Hydraulic fluid pressure is then applied to the hydraulic cylinder assembly 121 for extending the cylinder assembly housing 122 upwardly to lift the upper inner guide tubes 112 to upper end operating positions. The hydraulic fluid pressure is applied through the fitting 440 and the check valve 441 to the valve block assembly port 432 through which the fluid pressure is applied into the lower end of the piston tube 315, FIGS. 31A and 31B, through which the hydraulic fluid pressure is transmitted to the upper end of the piston rod assembly member 302. The pressure is applied outwardly and downwardly along the member 302 and radially outwardly in the passages 310 at the lower end of the cushion sleeve 293 into the cylinder chamber 311. Since the annular piston 304 is secured at a fixed position on the piston rod assembly 300, the hydraulic fluid pressure in the chamber 311 lifts the cylinder housing 122 raising the entire power assembly including the upper and lower sheave assemblies and the power cables. When the upper end of the air actuator 133 engages the lift plate 252 on the bottom of the crown assembly 113, continued upward extension of the hydraulic cylinder assembly raises the inner upper guide tubes 112 until the guide tubes reach upper extended operating positions as generally represented in FIG. 1A. When the upper guide tubes reach the upper end operating positions the locking lug 172 on each of the latch assemblies 170 on each of the lower outer guide tubes 111 is pivoted inwardly by the force of the springs 175 into the locking slot in the inner guide tube thereby locking the guide tube at the upper operating position. The compressed air pressure to the air actuator 133 is then relieved allowing the air actuator to collapse to the position represented in FIGS. 1A, 1B, and 1C at which several inches space, such as six or eight inches, is provided between the upper end of the hydraulic cylinder assembly housing 122 and the bottom of the crown assembly 113 preventing the hydraulic cylinder assembly from striking the crown assembly during the raising and lowering of the power assembly when the handling apparatus is operated for running and pulling well tubing. With the upper guide tube fully extended the guy wires 500 may be adjusted to proper tension to provide added support to the the guide tubes. Prior to the raising of the upper guide tubes the telescoping struts 155 in the guy wire rigging may be extended as shown in FIG. 5. If desired, though not always required, additional guy wires 502 may be connected from the frame 152 at the upper end of the main frame assembly to locations in the ground or on a platform outward from the base end of the apparatus.

FIG. 44 schematically illustrates the apparatus mounted on a wellhead prior to extension of the upper inner guide tubes. FIG. 45 shows schematically the apparatus with the upper guide tubes fully extended. FIGS. 46 and 47 represent stages in the operation of the apparatus during pulling and running tubing.

The tubing handling apparatus 100 is operated with the upper inner guide tubes fully extended for pulling tubing by alternately raising and lowering the traveling slips 130 by means of the hydraulic cylinder assembly 121. The upper end of the uppermost section of tubing in a tubing string is engaged by the traveling slips 130 which have been lowered from the upper end position at which the slips were located following the raising of the hydraulic cylinder assembly to extend the inner upper guide tubes. The slips 130 will include one set of slips for lifting and another set of slips for snubbing. The lifting slips are engaged with the tubing end at the wellhead to pull the tubing section upwardly. Also one of the winches 115 is operated to lower one of the pipe elevators 511 supported from one of the handling cables 510. The pipe elevator is connected with the extended upper end of the tubing section above the traveling slips. Hydraulic fluid pressure is then supplied to the cylinder assembly 121 into the upper cylinder chamber 311 of the assembly through the previously described valves and passages. The pressure in the chamber 311 lifts the cylinder housing 122 raising the entire power assembly to an upper end position at which the cylinder housing head member 294 engages the stop flange 322 as seen in FIGS. 31A and 31B. As the power assembly moves upwardly the upper and lower sheave assemblies 123 and 124 are lifted by the cylindrical housing 122 and since the power cables 125 are anchored at the links 373, the cables must travel around the sheaves raising the traveling slips from the lower end position as represented in FIGS. 1A and 1B to an upper end position as represented in FIG. 47. As the sheave assemblies 123 and 124 move upwardly with the back sides of the power cables anchored to the fixed frame assembly the traveling slips move twice the rate and twice the distance of the sheave assemblies and the cylinder housing 122. Thus, the traveling slips traverse the entire distance from the lower end position shown in FIG. 45 to an upper end position shown in FIG. 47 which is substantially twice the travel of the hydraulic cylinder assembly and sheave assemblies.

When the traveling slip assembly reaches the upper end position of FIG. 47, the fixed slip assembly 114 at the wellhead is operated to engage the next pipe section and the joint between the lifted pipe section and the next pipe section is broken at the wellhead. Also, the upper end of the lifted pipe section is released from the traveling slips at the upper end of the lifted pipe section leaving the lifted pipe section supported from the elevator 511 which is held by the cable 510 which had been raised by the winch 115 to which the cable is attached as the traveling slips raised the lifted pipe section. With the lower end of the lifted pipe section disengaged from the next pipe section at the wellhead and the upper end of the lifted pipe section disengaged from the traveling slips and supported from the elevator, personnel at the base of the handling apparatus below the work platform manipulate the pipe toward a pipe rack as the upper end of the lifted pipe section is lowered by means of the elevator.

During the lifting step the apparatus may be operated in either of two modes. For greater lifting capacity hydraulic pressure is applied into the cylinder housing 122 from the valve block assembly port 432 while simultaneously fluid is returned from the rod end of the hydraulic cylinder assembly through the valve block port 433 through the counterbalance valve 450 to the return fitting 444 through which the fluid flows back to the reservoir. For a higher speed lower lifting capacity the apparatus may be operated in the regenerative mode in which the hydraulic fluid is not returned to the reservoir from the rod end of the cylinder assembly but rather is directed through the two-way valve 451 back into the cylinder housing 122 joining the hydraulic fluid being pumped through the fitting 440 from the hydraulic pump.

The next step in the sequential operation of the apparatus is the lowering of the traveling slips to grasp and lift another pipe section of the tubing string being removed from the well bore. The power assembly is operated to retract the cylinder assembly 121 rotating the upper and lower sheave assemblies and thus the power cables clockwise as seen in FIG. 1B by applying hydraulic fluid pressure through the fitting 442, the check valve 443 and the valve assembly block port 433 into the rod end of the cylinder assembly. The fluid flows into the annular pressure chamber 312 between the head 294 and the fixed piston 304 thereby returning the cylinder assembly 122 downwardly. Return hydraulic fluid from the cylinder end of the hydraulic cylinder assembly flows through the valve block assembly port 432 and the dual counterbalance valves 445 to the return fitting 444 through which the fluid flows back to the reservoir. As the cylinder housing approaches the lower end of the down stroke the cushion sleeve 293 telescopes downwardly over the upper end member 302 of the rod assembly restricting return flow within the cushion sleeve around the member 302 providing a shock absorbing effect over the length of the cushion sleeve. The fluid in the chamber 311 within the cushion sleeve must flow between the cushion sleeve and the member 302 along the lower end of the cushion sleeve such as through the radial slots 310 into the outer annular portion of the chamber 311 thus providing the restricted flow shock absorbing effect.

When the traveling slips are again at the lower end of the stroke the slips are engaged with the upper end of the next pipe section which has been held by the fixed slip assembly 114 during the removal procedure of the preceding pipe section. The traveling slips are connected with the next pipe section to be removed and the fixed slips are released from the pipe section. The apparatus is then cycled through the lifting step to pull and remove another pipe section. During the procedure of connecting the traveling slips and releasing the fixed slips one of the pipe elevators 511 on one of the cables 510 is connected with the upper end of the next pipe section to be removed so that when the pipe section is at the upper end of the lifting stroke the elevator is available for lifting and swinging the pipe section out toward the pipe rack. In this connection it will be noted that there are two sets of pipe elevators 511, elevator cables 510, and winches 220 in the winch assembly 115, permitting manipulation of one of the elevators with the pipe section being pulled and the other of the elevators with the pipe section being removed to the pipe rack.

The handling apparatus 100 is useful for both running a tubing string back into a well bore by sequentially connecting and lowering the pipe length into the well bore through the wellhead and for pushing or snubbing the tubing string back into the well bore against well pressure which involves overcoming the well pressure in pushing the pipe sections downwardly into the well bore. During the normal lowering of the pipe sections the elevators 511 are used to lift the pipe sections and position the sections for connection with the traveling slips. At the completion of running a pipe section into the well bore the upper end of the section is held by the fixed slips while the next pipe section is lifted to a vertical position by one of the elevators manipulating the lower end of the section to make up a joint between such section and the section being held in the well bore inserting the lower end of the section being supported by the elevators downwardly through the traveling slips. When the joint is made up of the uppermost section in the well bore and the section being supported by the elevator, the traveling slips are then run up the section supported by the elevator until the slips reach the upper end of the elevator supported section at which time the traveling slips are engaged with the pipe section to be lowered. To assist the operator of the handling apparatus the traveling slip assembly may include a device known as a "Whizz-Bang" manufactured by Otis Engineering Corporation, Dallas, Texas, which automatically activates the traveling slips at the upper end of the stroke by mechanically striking the lower end of the pipe elevator. With the traveling slips engaged with the upper end of the elevator supported pipe section, the pipe section is then lowered into the well bore. Generally the weight of the tubing string is sufficient to carry the string downwardly into the well bore particularly if there is no significant well pressure. As previously indicated, the counterbalance valves are provided in the hydraulic circuit to the hydraulic cylinder assembly 121 for weight control. For example, the dual counterbalance valves 445 may be used to control fluid return from the cylinder housing end of the hydraulic cylinder assembly 122 thereby controlling the rate of descent of the traveling slips. Pipe sections are sequentially moved to the handling apparatus, connected with the tubing string in the well bore, and lowered into the well bore until the entire length of the tubing string has been run in the well bore.

In lowering or snubbing a tubing string into a well bore with the handling apparatus 100 against well pressure sufficient to require forcing the tubing string downwardly, the telescoping pipe guide 150 illustrated in detail in FIG. 15 is used and the traveling slips are operated over a shorter stroke than normally employed in running and pulling a tubing string. The lower end flange 271 on the pipe guide is connected with the upper end flange on the sleeve 145 of the main frame base 105. The upper flange 273 of the pipe guide is connected with the lower end of the traveling slip assembly 130. The traveling slips are operable through a stroke of the length of the pipe guide when extended telescoping the several concentric sections of the pipe guide to full length. FIGS. 1B and 1C show the pipe guide installed on the handling apparatus and connected with the lower end of the traveling slip assembly. As the traveling slips are cycled up and down the pipe guide telescopes between the fully extended position, not illustrated, and the fully retracted position as shown in FIG. 15 thereby providing a complete enclosure for the pipe being inserted to minimize the bending effect of forcing the pipe downwardly into the well bore against the well pressure. As previously indicated when snubbing pipe into the well bore hydraulic pressure is supplied to the fitting 442, the check valve 443, and the valve block assembly port 433 into the piston end of the hydraulic cylinder assembly 121. The return fluids from the cylinder end of the housing 122 flow through the counterbalance valves 445 to the return fitting 444.

During both pulling and running tubing strings in well bores the handling apparatus 100 may be fully supported in cantilever relation on the wellhead as indicated in FIG. 2. If desired additional bracing for the base of the main frame assembly may be supplied by adjustable brace assemblies 600 as shown in FIG. 1B. The brace assemblies extend from a platform or ground level to the bottom side of the frame 105 connecting with the socket fittings 213 shown in FIG. 19.

The handling apparatus 100 is dismantled in the subassemblies previously described in detail. The power assembly is used to lower the upper guide tubes 112 and crown 113. The power assembly is disconnected from the main frame assembly by disengagement of the bolts 431 holding the valve block 280 on the frame assembly base 105. The pin **374*a* is removed from the anchor links 373 and the anchor 162 along the main frame assembly mast 110. Of course, the hydraulic connections are disengaged from the various hydraulic fittings. The hydraulic fittings used permit the hydraulic power fluid to be left in the power assembly when the power assembly is disengaged from the main frame assembly. After all of the connections between the power assembly and the main frame assembly are broken, the power assembly is lifted by a suitable crane, not shown, from the main frame assembly. The main frame assembly may then be disengaged and lifted from the wellhead after supporting the main frame assembly from a suitable crane and disconnecting the bottom flange of the fixed slip assembly 114 from the top flange on the wellhead. Prior to taking the main frame assembly down the work platform 104 is taken off. The ladder 103** may be left connected with the main frame assembly until the main frame assembly has been lowered to a horizontal position.

While the apparatus 100 has been described as being erected and dismantled in the separate subassemblies, the apparatus also may be handled as a unit comprising the main frame assembly, the work platform, and the power assembly where the combined weight is not a problem. Under such circumstances the apparatus may be erected on a wellhead as shown in FIG. 2 by use of a crane 600.

FIG. 48 schematically represents a dual arrangement of the apparatus of the invention for handling larger capacities wherein essentially a single frame base 105*a* is used with two sets of lower guide tubes 111, upper guide tubes 112, and main frame mast members 110. Dual hydraulic and valve block assemblies 280 on the frame base are also used for operating both of the power assemblies. The power assemblies each include power cables 125 which are jointly connected along front sides to a single traveling slip assembly 130*a*. With such an arrangement on a wellhead 521 mounted on a single set of fixed lower slips 114 the power of the two hydraulic systems is available for running and pulling a single tubing string in the well bore.

It will now be seen that a new and improved form of well tubing handling apparatus has been described and illustrated. The apparatus is readily dismantled in several subassemblies each of which are sufficiently light in weight and compact to be handled by such means as helicopters enabling the apparatus to be mounted on remotely located wells particularly in offshore locations by carrying the subassemblies separately and erecting the apparatus directly on the wellhead. The apparatus is fully supportable from the wellhead alone thereby eliminating the need for the forces involved in raising and lowering tubing strings to be transmitted to a platform which may not be normally designed to handle such weight loads. The apparatus includes various quick connect and disconnect couplings to facilitate the erection and dismantling of the apparatus such particularly as wrap around bearing assemblies on the upper and lower sheave assemblies of the power assembly for connection on the guide tubes of the main frame assembly. The apparatus includes such features as an inflatable air actuator on the upper end of the power assembly to facilitate raising the upper guide tubes above the upper end of the stroke of the power assembly so that the crown assembly is safely above the power assembly during reciprocation of the power assembly. Guy wires are not required to the top of the main frame assembly when the upper guide tubes are fully extended. An anti-rotation guide is included between the traveling slips and the upwardly extendible cylinder housing so that the traveling slip assembly may include a rotary head for turning the tubing string for cleanout and drilling operations. The entire hydraulic system other than the controls and the power source is included in the hydraulic power cylinder assembly and the valve block assembly which are secured together in an integral relationship in the power subassembly so that hydraulic fluid may remain in the cylinder block and cylinder assembly at all times thereby minimizing erection and dismantling time. Pipe handling winches are included in the main frame assembly and thus do not have to be removed and reinstalled when erecting and dismantling the apparatus. The crown on the upper guide tubes is an integral part of the main frame assembly. The stationary slip assembly may be disconnected from the main frame assembly for removal of the apparatus from a wellhead in the event of malfunction leaving the tubing supported from the fixed slips so that another rig may be placed on the well to complete an interrupted job. The main frame is always mounted on the top of a wellhead providing full stroke operation of the power assembly regardless of the height of the wellhead. The apparatus may be supported on the blowout preventor stack so that such stack does not extend up into the frame assembly limiting the stroke. The loads carried by the handling apparatus are not imposed on the guide tubes but are rather transmitted through a single mast member to the wellhead and absorbed by well casing and the like on which the wellhead is mounted.

What is claimed is:

1. Well tubing handling apparatus comprising: a frame assembly including assembly guide and quick connect and disconnect means; means for mounting said frame assembly directly on a wellhead in a self-supporting relationship; and a separate removable hydraulic power assembly connectible on said frame assembly including tubing holding means and means for raising and lowering said tubing holding means relative to said wellhead for lifting tubing strings from a well bore and forcing tubing strings downwardly into a well bore, said hydraulic power assembly having assembly guide and quick connect and disconnect means operable with said assembly guide and quick connect and disconnect means on said frame assembly.

2. A well tubing handling apparatus in accordance with claim 1 wherein said power assembly includes a hydraulically extendible member for moving said tubing holding means and means providing an operating stroke for said tubing holding means greater than the length of travel of said extendible member.

3. A well tubing handling apparatus in accordance with claim 2 wherein said power assembly includes a hydraulic cylinder comprising said hydraulically extendible member operable on a stationary piston rod assembly.

4. A well tubing handling apparatus in accordance with claim 3 wherein said power assembly includes longitudinally spaced sheave assemblies on said hydraulic cylinder, a continuous cable anchored along a back side to an upper portion of said frame assembly supporting along a front side said tubing holding means.

5. A well tubing handling apparatus in accordance with claim 4 wherein said frame assembly includes non-load bearing guide tubes and said power assembly includes split sleeve bearings connectible on said guide tubes at said sheave assemblies for guiding said power assembly upwardly and downwardly along said guide tubes.

6. Well tubing handling apparatus in accordance with claim 5 including means connected with said power assembly for engaging and raising said guide tubes of said frame assembly by means of operation of said power assembly.

7. Well tubing handling apparatus in accordance with claim 6 wherein said frame assembly includes a load bearing mast member extending substantially parallel with said guide tubes and spaced therefrom and said cable is anchored to said mast member.

8. Well tubing handling apparatus in accordance with claim 7 including an anti-torque guide assembly between said tubing holding means and said cylinder of said hydraulic cylinder assembly for resisting torque applied to said tubing holding means when said holding means is employed for rotating well tubing.

9. Well tubing handling apparatus in accordance with claim 7 including a valve block assembly having hydraulic valves, flow passage means, and fluid couplings for connection of said power assembly with a source of hydraulic fluid pressure and adapted to retain hydraulic fluid in said power assembly hydraulic cylinder when said power assembly is uncoupled from said frame assembly.

10. Well tubing handling apparatus in accordance with claim 9 in combination with a wellhead providing support for said apparatus over a well bore.

11. Well tubing handling apparatus in accordance with claim 9 wherein said hydraulic cylinder of said power assembly includes a pressure chamber at the cylinder end of said assembly for hydraulic fluid pressure for raising said cylinder and a smaller annular pressure chamber at the piston end of said assembly for hydraulic fluid pressure for lowering said cylinder.

12. Well tubing handling apparatus in accordance with claim 11 wherein said hydraulic cylinder assembly includes means defining a central longitudinal flow passage leading to said cylinder chamber and an annular longitudinal flow passage around said central flow passage leading to said smaller annular pressure chamber.

13. Well tubing handling apparatus in accordance with claim 11 including regenerative hydraulic circuit connections between said pressure chamber at said cylinder end of said power assembly and said annular pressure chamber at said piston end of said assembly are interconnected by a regenerative hydraulic circuit for increasing the rate of movement of said power assembly during a pulling mode of operation.

14. Well tubing handling apparatus in accordance with claim 7 wherein said means for mounting said frame assembly directly on said wellhead comprises a set of fixed slips for holding well tubing in said well bore against upwardly and downwardly directed forces on said well tubing.

15. Well tubing handling apparatus in accordance with claim 7 including winch and cable means connected on said frame assembly for moving pipe sections to and from said tubing holding means of said power assembly.

16. Well tubing handling apparatus in accordance with claim 15 including a removable work platform connectible on said frame assembly for supporting work personnel and control apparatus.

17. Well tubing handling apparatus in accordance with claim 15 including guy wire rigging means between upper portions of said guide tubes and lower portions of said frame assembly.

18. Well tubing handling apparatus comprising: a frame assembly having a base adapted to be mounted on a wellhead, guide tubes secured at one end in lateral spaced relationship on said base, and a mast member secured at one end in lateral spaced relation from said guide tubes; and a power assembly connected with said frame assembly including a hydraulic cylinder unit having a piston rod connected at a free end with said frame assembly base, a movable cylinder housing on said piston rod adapted to move in opposite longitudinal directions relative to said frame base substantially parallel with said guide tubes, a sheave assembly mounted on each opposite end portion of said cylinder housing, a continuous loop cable mounted on said sheave assemblies, a cable anchor mounted along a back section of said cable between said sheave assemblies secured to an upper end portion of said mast member, and a tubing section holding assembly mounted along a front section of said cable between said sheave assemblies for moving a tubing section responsive to travel of said cable on said sheave assemblies as said hydraulic cylinder is extended and retracted relative to said piston rod.

19. Well tubing handling apparatus in accordance with claim 18 wherein said frame assembly and said power assembly are separate subassemblies of said handling apparatus adapted to be coupled together and uncoupled from each other as said apparatus is erected on and removed from a wellhead.

20. Well tubing handling apparatus in accordance with claim 19 wherein said frame assembly includes a fixed slip assembly for connecting said frame assembly on a wellhead.

21. Well tubing handling apparatus in accordance with claim 18 wherein said tubing section holding assembly is adapted to move a substantially greater distance than the travel distance of said cylinder housing.

22. A tubing handling apparatus in accordance with claim 21 wherein said frame assembly and said power assembly are separate subassemblies adapted to be coupled together and uncoupled from each other during erection and dismantling of said apparatus on a wellhead.

23. Well tubing handling apparatus comprising: mounting means for supporting said apparatus directly on a wellhead; and a power assembly on said mounting mean for raising and lowering tubing string in a well bore through said wellhead including a hydraulic cylinder assembly having a piston secured at a free end with said mounting means and a cylinder movable on said piston, a sheave supported along opposite end portions of said cylinder, a continuous cable over said sheaves, an anchor between a back side of said cable between said sheaves and said mounting means, and slip engaging means mounted on a front portion of said cable between said sheaves adapted to move with said cable relative to said mounting means as said cable travels around said sheaves responsive to movement of said cylinder relative to said piston and said mounting means.

24. Well tubing handling apparatus in accordance with claim 23 wherein said mounting means and said power assembly are separate subassemblies of said handling apparatus adapted to be coupled and uncoupled during erection and dismantling of said apparatus on said wellhead.

25. Well tubing handling apparatus in accordance with claim 24 wherein said mounting means includes a fixed slip assembly for engaging and holding pipe sections while said power assembly is operating.

26. Well tubing handling apparatus in accordance with claim 23 including two power assemblies secured with said mounting means and coupled with a single tubing holding means.

27. Load handling apparatus comprising: mounting means; and power assembly means on said mounting means including a hydraulic power cylinder having a piston secured at a free end with said mounting means and a cylinder movable on said piston toward and away from said mounting means, a sheave assembly mounted along each end portion of said cylinder, a continuous power cable around said sheaves, an anchor between a back portion of said power cable between said sheaves and said mounting means, and load holding means on a front portion of said cable between said sheaves for moving a load with said cable relative to said mounting means as said cable is moved around said sheaves responsive to movement of said cylinder on said piston rod.

28. Load handling apparatus in accordance with claim 27 wherein said power cylinder includes a first pressure chamber at a first end thereof for hydraulic fluid for moving said cylinder in a first direction away from said mounting means and a second pressure chamber around said piston rod at an opposite end of said cylinder for hydraulic fluid for moving said cylinder in a second direction toward said mounting means.

29. Load handling apparatus in accordance with claim 28 wherein said mounting means comprises a first subassembly and said hydraulic cylinder, sheaves, and power cable comprise a second subassembly, said subassemblies being connectible and disconnectible for erecting and dismantling said load handling apparatus.

30. Load handling apparatus in accordance with claim 29 wherein said mounting means comprises a frame assembly having a base connectible with said piston rod and guide tubes and a mast member connectible with said power cable and said sheaves.

31. Well tubing handling apparatus for running and pulling well tubing in a well bore comprising: a frame assembly having a base, means for connecting said base with a wellhead including a fixed slip assembly to hold tubing against upward and downward forces at said wellhead, a pair of laterally spaced guide tube assemblies secured at a first end with said base and including first fixed guide tubes and second telescopic movable guide tubes in said first fixed guide tubes, a latch assembly along an end portion of each of said fixed guide tubes at opposite ends of said fixed guide tubes from said base for locking said movable guide tubes when said movable guide tubes are fully extended relative to said fixed guide tubes, said latch assemblies being remotely controllable, a crown assembly on the free ends of and between said movable guide tubes including cable sheaves, winch means on said base, cable means from said winch means over said sheaves on said crown assembly, and pipe elevator means on free ends of said cable means from said winch means, a mast member mounted at a first end on said base extending in parallel spaced relation with said guide tubes; and a power assembly on said frame assembly including a hydraulic cylinder assembly having a cylinder housing and a piston rod, a valve block assembly connected with the free end of said piston rod and mounted on said frame assembly base for directing hydraulic fluid to and from said hydraulic cylinder assembly, said cylinder housing being movable toward and away from said frame assembly base on said piston rod, said cylinder assembly including an annular piston on said piston rod in said cylinder housing defining with said piston rod and said cylinder housing a first hydraulic fluid pressure chamber at a cylinder head end of said cylinder housing and a second annular hydraulic pressure chamber in said cylinder housing at the piston end of said housing, a first sheave assembly mounted along the head end of said cylinder housing including a cable sheave and guide sleeve bearing means movable along said extendible guide tubes, a second sheave assembly mounted on said cylinder housing at the piston rod end of said housing including guide sleeve bearing means slidable along said fixed guide tubes, a continuous power cable mounted on said sheaves extending substantially parallel with said guide tubes and said frame assembly mast member, a cable anchor between a back portion of said cable between said sheaves and an upper end portion of said frame assembly mast member anchoring said cable to said mast member near the end of said mast member away from said base, an inflatable sleeve mounted on the head end of said cylindrical housing and extendible from said head end to engage said crown assembly on said extendible guide tubes for raising said guide tubes and positioning said crown assembly in spaced relation above the upper end of said cylinder housing, and a tubing engaging slip assembly mounted along a front portion of said cable between said sheaves for travel between said sheave at said piston end of said cylinder housing and said sheave at said head end of said cylinder housing whereby said slip assembly is moved from near said frame base to near said crown assembly responsive to extension and retraction of said cylinder housing.

32. Well tubing handling apparatus in accordance with claim 31 wherein said frame assembly and said power assembly are separate subassemblies adapted to be coupled together and disengaged during erection and dismantling of said apparatus on a wellhead.

33. Well tubing handling apparatus in accordance with claim 32 including a ladder assembly and a work platform adapted to be secured on said frame assembly.

34. Well tubing handling apparatus in accordance with claim 32 including rigging guide rods on said frame assembly at said base and along an opposite end portion of said mast member and female rigging guide members on said power assembly at opposite ends of said hydraulic cylinder assembly engageable with said alignment rods on said frame assembly for aligning said power assembly with frame assembly during erection of said apparatus.

35. Well tubing handling apparatus in accordance with claim 34 including a valve block assembly secured with said piston end of said hydraulic cylinder assembly including hydraulic fluid flow passages and valves and quick disconnect fittings for directing hydraulic fluid to and from said hydraulic cylinder assembly from a source of hydraulic fluid under pressure.

36. Well tubing handling apparatus in accordance with claim 35 wherein said sheave assemblies each include two sheaves positioned in vertical planes arranged at an acute angle with said mast member whereby the back sides of said sheaves are closely spaced together along said mast member and the front sides of said sheaves are more widely spaced apart and one of said power cables is reaved around each pair of upper and lower sheaves on the same side of said power assembly and both of said cables are anchored with said upper end portion of said mast member.

37. Well tubing handling apparatus in accordance with claim 36 including a guide assembly and anti-torsion means on said front portions of said cable supporting said sheave assembly on said cables and having rollers engageable with said fixed guide tubes in an anti-torsion guide shoe slidable along a guide track along a front side of said cylinder housing.

* * * * *